US005439787A

United States Patent [19]

Yamanouchi et al.

[11] Patent Number: 5,439,787

[45] Date of Patent: Aug. 8, 1995

[54] SILVER HALIDE PHOTOGRAPHIC EMULSION AND PHOTOGRAPHIC MATERIAL CONTAINING THE SAME

[75] Inventors: Junichi Yamanouchi; Yoichi Hosoya; Shigeharu Urabe, all of Kanagawa, Japan

[73] Assignee: Fuji Photo Film Co. Ltd., Kanagawa, Japan

[21] Appl. No.: 271,662

[22] Filed: Jul. 7, 1994

[30] Foreign Application Priority Data

Jul. 7, 1993 [JP] Japan ..... 5-191814

[51] Int. Cl.[6] ..... G03C 1/005

[52] U.S. Cl. ..... 430/567; 430/569; 430/634; 430/637

[58] Field of Search ..... 430/567, 569, 634, 637

[56] References Cited

U.S. PATENT DOCUMENTS 3,150,977 9/1964 Hart et al. .
4,278,759 7/1981 Saleck et al. .
4,797,354 1/1989 Saitou et al. .
5,147,773 9/1992 Tsaur et al. .
5,215,879 6/1993 Suzuki et al. ..... 430/569

FOREIGN PATENT DOCUMENTS 0514742 11/1992 European Pat. Off. ..... G03C 1/07
2838 1/1990 Japan ..... G03C 1/035

*Primary Examiner*—Thorl Chea
*Attorney, Agent, or Firm*—Sughrue, Mion, Zinn, Macpeak & Seas

[57] ABSTRACT

A silver halide photographic emulsion prepared in the presence of at least one member of polymers comprising at least one repeating unit derived from at least one member of monomers represented by the following formula (1)

(1)

wherein $R^1$ represents a hydrogen atom or a lower alkyl group; $R^2$ represents a monovalent substituent group; $R^3$ represents an alkylene group having 3 to 10 carbon atoms; L represents a bivalent bonding group; and n represents the mean number of a repeating unit represented by $—R^3—O—$ and is a number of at least 4, but not more than 200.

9 Claims, 1 Drawing Sheet

SILVER HALIDE PHOTOGRAPHIC EMULSION AND PHOTOGRAPHIC MATERIAL CONTAINING THE SAME

FIELD OF THE INVENTION

The present invention relates to a tabular silver halide grain emulsion having excellent monodispersibility and a silver halide photographic material containing the tabular silver halide grain emulsion. More particularly, it relates to a silver halide emulsion comprising hexagonal tabular grains having a uniform hexagonal form and a silver halide photographic material which contains the above tabular grain emulsion and is excellent in graininess, sensitivity/fog ratio and sharpness.

BACKGROUND OF THE INVENTION

Silver halide grains having two or more parallel twinning planes have a tabular form (hereinafter referred to as tabular grains). The tabular grains have the following photographic characteristics.

(1) The ratio of the surface area of the grain to the volume thereof (hereinafter referred to as specific surface area) is high, and hence large amounts of sensitizing dyes can be adsorbed by the surface of the grain. Accordingly, color-sensitized sensitivity is relatively high.

(2) When emulsions comprising the tabular grains are coated on a support and dried, the grains are arranged parallel to the surface of the support. Accordingly, light scattering caused by the grains can be reduced, and sharpness and resolving power can be improved. Further, the thickness of the coated layer can be reduced by the above arrangement, and sharpness can be improved.

(3) The rate of development is rapid because the specific surface area is large.

(4) Covering power is high, and hence the amount of silver used can be saved.

The tabular grains have many advantages as described above, and hence the tabular grains have been conventionally used in marketing photographic materials having high sensitivity.

JP-A-58-113926 (the term "JP-A" as used herein means an "unexamined published Japanese patent application"), JP-A-58-113927 and JP-A-58-113928 disclose emulsions comprising grains having an aspect ratio of 8 or higher. The term "aspect ratio" as used herein refers to the ratio of the diameter of the tabular grain to the thickness thereof. The diameter of the grain is defined at the diameter of a circle having an area equal to the projected area of the grain. The thickness of the grain refers to a distance between two parallel principal surfaces constituting the tabular grain.

Tabular grains conventionally prepared have poor monodispersibility as shown in Examples of the above-described patent specifications. This means that 1) the tabular grains have a wide grain size distribution in terms of the diameter of the circle of the corresponding projected area, and 2) cylindric grains, tetrapod-form grains, singlet twin grains and grains having non-parallel twinning planes are mixed with the tabular grains.

Accordingly, the tabular grains have disadvantages in that 1) high contrast (namely, high gamma value) on the characteristic curve can not be expected;

2) when emulsions comprising larger size grains and smaller size grains are chemical-sensitized, it is difficult that both the larger size grains and the smaller size grains are simultaneously chemical-sensitized best because the larger size grains and the smaller size grains are different in the optimum conditions from each other; and 3) an interlayer effect can not be sufficiently utilized. A multi-layer coat comprising an upper layer containing the monodisperse larger size grains and a lower layer containing the monodisperse smaller size grains provides high sensitivity from the viewpoint of the utilization of light in comparison with the emulsion coated layer wherein the larger size grains and the smaller size grains are mixed with each other.

Accordingly, many attempts have been made to obtain monodisperse tabular grains as disclosed in many patent specifications. For example, JP-A-52-153428 discloses the preparation of monodisperse tabular grains. In the method described in this patent specification, however, AgI crystal must be used as the nucleus, and the proportion of the tabular grains contained in the resulting grains is small. JP-A-55-142329 discloses the growth conditions of grains for obtaining monodisperse tabular grains. However, the proportion of the tabular grains contained in the resulting grains is small. JP-A-51-39027 discloses a method wherein monodisperse twin grains are ripened by adding solvents for silver halide after nucleation, and the grains are then grown. In this method, the proportion of the tabular grains contained in the resulting grains is small, and the resulting tabular grains have a low aspect ratio. JP-A-61-112142 also discloses the preparation of monodisperse twin grains as disclosed in the above patent specification, as a grain forming process. In this patent, however, since spherical grains are used as a seed crystal, only tabular grains having an aspect ratio of 2.2 or below are formed, and only tabular grain emulsions wherein the proportion of the tabular grains is low are obtained. French Patent 2,534,036 discloses a method wherein monodisperse tabular grains are ripened without using any solvent for silver halide after nucleation. The resulting tabular grains have a coefficient of variation (a value obtained by dividing the standard deviation (in terms of the diameter of the corresponding circle) by the mean grain size (in terms of the average diameter of the corresponding circles) and multiplying the quotient by 100) of 15%. When calculated from the photographs of the grains described in Examples of this patent specification, triangular tabular grains account for at least 50% of the entire projected areas of the entire grains. The triangular tabular grains refer to grains which have three parallel twinning planes on the principal surface according to J. E. Maskasky, *J. Imaging Sci.*, 31 (1987), pp. 15–26.

JP-A-63-11928, JP-A-63-151618 and JP-A-2-838 disclose monodisperse tabular grains including hexagonal tabular grains. The hexagonal tabular grains are tabular grains having two parallel twinning planes, unlike the above-described triangular tabular grains. There is disclosed in Example 1 of the aforesaid JP-A-2-838 that monodisperse tabular grains comprise grains having such a proportion that tabular grains having two parallel twinning planes account for 99.7% of the entire projected areas of the entire grains and have a coefficient of variation in terms of the diameter of the corresponding circle of 10.1%.

U.S. Pat. Nos. 5,147,771, 5,171,659, 5,147,772 and 5,147,773 disclose a process for preparing monodisperse tabular grains by allowing polyalkylene oxide block copolymers to be present during nucleation. EP-A-514742 discloses monodisperse tabular grain emulsions comprising grains having a coefficient of variation of 10% or lower. In all of Examples of this patent specification, the above-described polyalkylene oxide block copolymers are used.

However, when tabular grains are prepared according to the method described in Examples of the above-described patent specification, there are formed tabular grains having a distorted form wherein the six sides of a sexangle are randomly different in the length from one another, though monodisperse tabular grains are obtained.

It is generally known that an ideal picture element arrangement is in the form of a honeycomb structure when the arrangement of each picture element is examined by an image sensor. Tabular grains having a regular hexagonal form are preferred (see, L. C. Dainity and R. Shaw, *Image Science,* Academic Press, London, 1974). Accordingly, it has been demanded to provide hexagonal tabular grains having a uniform hexagonal form. It has been confirmed that the monodisperse tabular grain emulsions prepared according to the above-described patent specifications have photographic advantages in that properties with regard to high contrast and graininess are improved. However, an improvement in the sensitivity/fog ratio is still insufficient. Accordingly, a further improvement has been demanded.

SUMMARY OF THE INVENTION

An object of the present invention is to provide a silver halide tabular grain emulsion comprising grains having a uniform hexagonal form and excellent monodispersibility.

Another object of the present invention is to provide a silver halide photographic material containing the above silver halide tabular grain emulsion, thereby enabling graininess, sensitivity/fog ratio and sharpness to be improved, and enabling high sensitivity to be achieved.

The above-described objects of the present invention have been achieved by providing the following materials.

[1] A silver halide emulsion prepared in the presence of at least one member of polymers comprising at least one repeating unit derived from at least one member of monomers represented by the following formula (1)

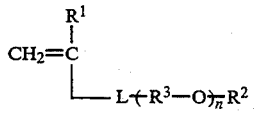

(1)

wherein $R^1$ represents a hydrogen atom or a lower alkyl group; $R^2$ represents a monovalent substituent group; $R^3$ represents an alkylene group having 3 to 10 carbon atoms; L represents a bivalent bonding group; and n represents the mean number of a repeating unit represented by $—R^3—O—$ and is a number of at least 4, but not more than 200.

[2] A silver halide emulsion as described in [1] above, wherein the polymers are copolymers comprising at least one repeating unit derived from at least one member of the monomers represented by the formula (1) and at least one repeating unit derived from at least one member of monomers represented by the following formula (2)

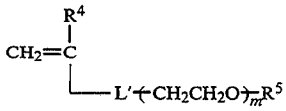

(2)

wherein $R^4$ represents a hydrogen atom or a lower alkyl group; $R^5$ represents a monovalent substituent group; L' represents a bivalent bonding group; and m represents the mean number of a repeating unit represented by $—CH_2CH_2O—$ and is a number of at least 4, but not more than 200.

[3] A silver halide photographic emulsion as described in [1] above, wherein the silver halide emulsion comprises tabular grains having an aspect ratio of at least 2 and a coefficient of variation in a grain size distribution in terms of the diameter of the corresponding circle of 15% or lower.

[4] A silver halide photographic material comprising a support having thereon at least one light-sensitive silver halide emulsion layer, wherein the silver halide emulsion layer contains a silver halide emulsion as described in [1] above.

DETAILED DESCRIPTION OF THE INVENTION

Figure 1A:
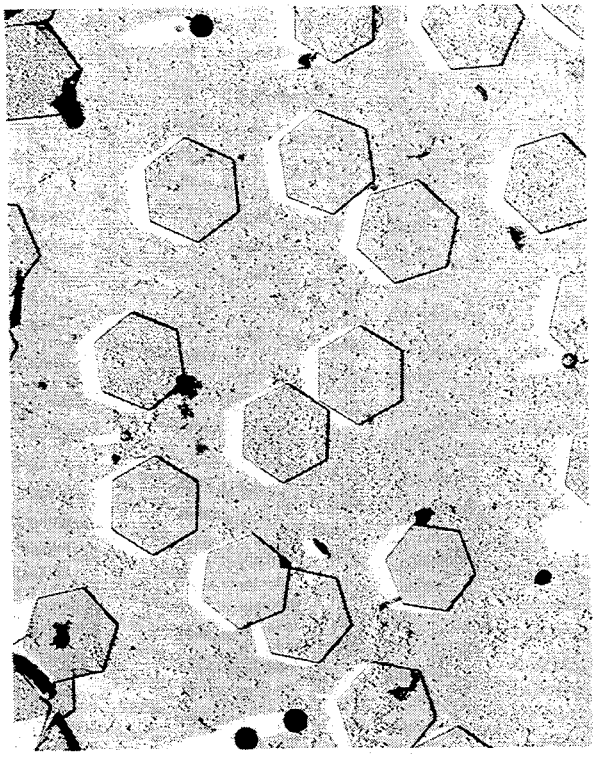
FIG. 1A and FIG. 1B are the transmission electron micrographs (6,000×magnification) of the replicas of the crystal structures of the grains prepared in Example 1 and Comparative Example 1, respectively, wherein black spheres are latex particles used for the purpose of the comparison of size.

The silver halide emulsion of the present invention is a silver halide emulsion comprising a dispersion medium and silver halide grains, wherein tabular grains having two twinning planes parallel to the principal surface account for at least 95% of the entire projected areas of the silver halide grains, and the tabular grains have a hexagonal form and such a grain size distribution that the tabular grains are monodisperse.

The term "hexagonal tabular grains" as used herein refers to tabular grains wherein the ratio of the lengths of the two adjoining sides of the six sides of a hexagon is 2 or less, and a difference between the ratio of the lengths of any two adjoining sides of the six sides and that of the lengths of other two adjoining sides thereof is not greater than 10%.

A feature of the monodisperse hexagonal tabular grains of the present invention resides in that the grains are monodisperse. The term "monodisperse" or "monodispersibility" as used herein refers to dispersity determined by a coefficient of variation. The tabular grains of the present invention have monodispersibility in terms of a coefficient of variation of preferably 15% or lower.

The monodisperse hexagonal tabular grains of the present invention have an average aspect ratio of 2 or higher. The term "average aspect ratio" as used herein refers to the mean value of the aspect ratios of the entire tabular grains having a diameter of not smaller than 0.2 μm contained in the emulsion.

Now, the polymers used in the present invention will be illustrated in greater detail below.

The polymers used in the formation of the tabular grains of the present invention are polymers comprising at least one repeating unit derived from at least one member of the monomers represented by the following formula (1), preferably polymers comprising at least one repeating unit derived from at least one member of the monomers represented by the formula (1) and at least one repeating unit derived from at least one member of the monomers represented by the following formula (2)

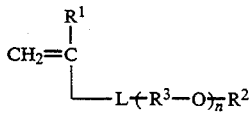

(1)

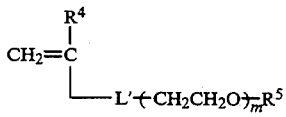

(2)

In the formulas (1) and (2), $R^1$ and $R^4$ may be the same or different and each represents a hydrogen atom or a lower alkyl group having 1 to 4 carbon atoms (e.g., methyl, ethyl, n-propyl, n-butyl). Particularly preferably, $R^1$ and $R^4$ are each a hydrogen atom or a methyl group.

$R^2$ and $R^5$ may be the same or different and each represents a monovalent substituent group. Specific examples of the monovalent substituent group which can be preferably used include a hydrogen atom, a substituted or unsubstituted alkyl group (e.g., methyl, ethyl, isopropyl, n-hexyl, n-dodecyl, benzyl, 2-cyanoethyl, 2-chloroethyl, 3-methoxypropyl, 4-phenoxybutyl, 2-carboxyethyl, $—CH_2CH_2SO_3Na—$, $—CH_2CH_2NHSO_2CH_3$), a substituted or unsubstituted aryl group (e.g., phenyl, p-methylphenyl, p-methoxyphenyl, o-chlorophenyl, p-octylphenyl, naphthyl), an acyl group (e.g., acetyl, propionyl, benzoyl, octanoyl) and a carbamoyl group (e.g., $—CONHCH_3$, $—CON(CH_3)_2$, $—CONHC_6H_{13}$). Particularly preferably, $R^2$ and $R^5$ are each a hydrogen atom, a methyl group, an ethyl group, a phenyl group or an acetyl group.

L and L' may be the same or different and each represents a bivalent bonding group, preferably a group represented by the following formula (IV) or (V)

$$—CO—X_1—L_1—X_2— \quad (IV)$$

wherein $X_1$ represents an oxygen atom or a group of $—NR^6—$ (wherein $R^6$ represents a hydrogen atom, a substituted or unsubstituted alkyl group, a substituted or unsubstituted aryl group, a substituted or unsubstituted acyl group or a group of $—L_1—X_2—(R^3—O)_n—R^2$ (in the formula (1)) or $—L_1—X_2—(CH_2CH_2O)_m—R^5$ (in the formula (2)), and preferably $R^6$ is a hydrogen atom, a substituted or unsubstituted alkyl group having 1 to 10 carbon atoms (e.g., methyl, ethyl, n-butyl, n-octyl), a group of $—L_1—X_2—(R^3—O)_n—R^2$ or $—L_1—X_2—(CH_2CH_2O)_m—R^5$ or an acyl group (e.g. , acetyl, benzoyl)).

Particularly preferably, $X_1$ is an oxygen atom or —NH—.

$L_1$ represents a single bond, a substituted or unsubstituted alkylene group (e.g., dimethylene, trimethylene, tetramethylene, decamethylene, methyldimethylene, phenyldimethylene, $—CH_2(C_6H_4)CH_2—$, $—CH_2CH_2NHCOOCH_2—$) or a substituted or unsubstituted arylene group (e.g., o-phenylene, m-phenylene, p-phenylene, methylphenylene). Particularly preferably, $L_1$ is a single bond or $—(CH_2)_l—$ (wherein l is an integer of 3 to 12).

$X_2$ represents a single bond, an oxygen atom, —COO—, —OCO—, $—CONR^6—$, $—NR^6CO—$, $—OCOO—$, $—NR^6COO—$, $—OCONR^6—$, or $NR^6—$ (wherein $R^6$ is as defined above). Particularly preferably, $X_2$is a single bond, an oxygen atom —COO—, —CONH—, —NHCOO—, or —NHCONH—.

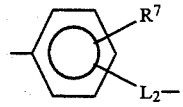

(V)

wherein $R^7$ represents a hydrogen atom, a halogen atom, a substituted or unsubstituted alkyl group or a substituted or unsubstituted acyl group. Preferably, $R^7$ is a hydrogen atom, a chlorine atom, a lower alkyl group having not more than 6 carbon atoms or a lower acyl group with a hydrogen atom and a methyl group being particularly preferred. $L_2$ represents a single bond, $—L_1—$, $—X_2—$, $—L_1—X_2—$, $—X_1—L_1—X_2—$, or $—CO—X_1—L_1—X_2—$(wherein $X_1$, $X_2$ and $L_1$ are as defined above). $L_2$ is preferably $—L_1—$, $—X_2—$, or $—L_1—X_2—$, and particularly preferably $—CH_2O—$, —COO—, —CONH— or —O—.

$R^3$ represents an alkylene group having at least 3 carbon atoms. Specific examples of the alkylene group include $—CH(CH_3)CH_2—$, $—CH_2CH(CH_3)—$, $—CH_2CH_2CH_2—$, $—CH_2CH(OH)CH_2—$, $—(CH_2)_4—$ and $—(CH_2)_5—$. Particularly preferably, $R^3$ is $—CH(CH_3)CH_2—$ or $—CH_2CH(CH_3)—$.

With respect to the repeating unit represented by $R^3—O$, only one kind of the repeating unit may be present per one monomer or two or more kinds of the repeating units may be present in a copolymerized form per one monomer.

n and m each represents an average number of moles of each repeating unit, and n is preferably 4 to 50, particularly preferably 6 to 40, and m is preferably 4 to 100, particularly preferably 6 to 50.

Specific examples of the monomers of the formula (1) which can be preferably used include, but are not limited to, the following compounds.

MP-1~5

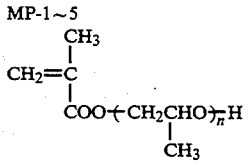

MP-1 n = 6
MP-2 n = 9
MP-3 n = 12
MP-4 n = 20
MP-5 n = 40

MP-6~8

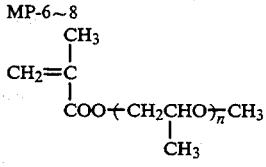

MP-6 n = 4
MP-7 n = 12
MP-8 n = 30

MP-9

-continued

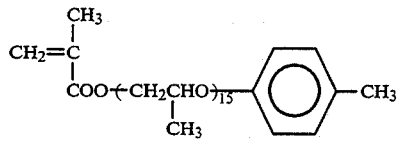

MP-10, 11

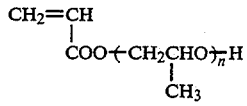

MP-10 n = 6
MP-11 n = 18

MP-12

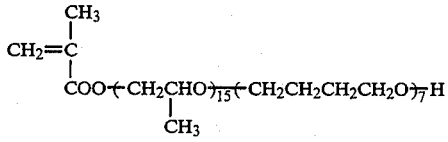

MP-13

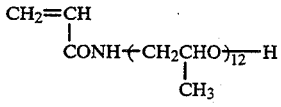

MP-14, 15

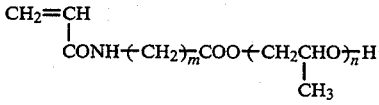

MP-14 m = 5, n = 25
MP-15 m = 3, n = 12

MP-16, 17

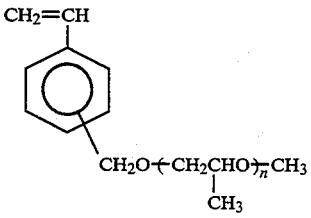

MP-16 n = 8
MP-17 n = 20

MP-18

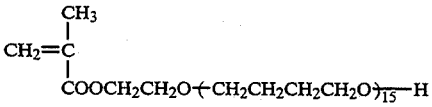

Specific examples of the monomers of the formula (2) which can be preferably used include, but are not limited to, the following compounds.

ME-1~5

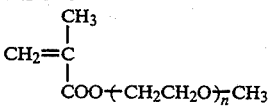

ME-1 n = 4
ME-2 n = 9
ME-3 n = 15
ME-4 n = 23
ME-5 n = 50

ME-6, 7

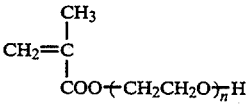

ME-6 n = 6
ME-7 n = 20

ME-8, 9

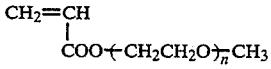

ME-8 n = 9
ME-9 n = 30

ME-10

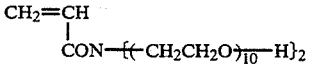

ME-11

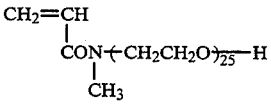

ME-12~14

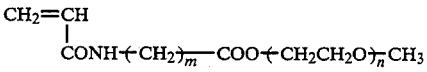

ME-12 m = 1, n = 20
ME-13 m = 3, n = 15
ME-14 m = 10, n = 30

ME-15, 16

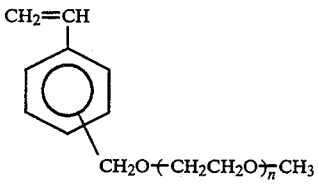

ME-15 n = 8
ME-16 n = 15

In the polymers for use in the present invention comprising the repeating unit(s) derived from the monomer(s) represented by the formula (1), other monomers than the monomers represented by the formula (2) may be used as monomers to be copolymerized.

Examples of the copolymerizable monomers include acrylic esters, methacrylic esters, acrylamides, methacrylamides, vinyl esters, vinylketones, allyl compounds, olefins, vinyl ethers, N-vinylamides, heterocyclic vinyl compounds, maleic esters, itaconic esters, fumaric esters and crotonic esters. Specific examples of the copolymerizable monomers include hydrophobic monomers which form water-insoluble homopolymers, such as methyl acrylate, ethyl acrylate, n-propyl acrylate, n-butyl acrylate, sec-butyl acrylate, octyl acrylate, diethylene glycol monoacrylate, trimethylol ethane monoacrylate, 1-bromo-2-methoxyethyl acrylate, p-chlorophenyl acrylate, methyl methacrylate, ethyl methacrylate, N-tert-butyl acrylamide, hexyl acrylamide, octyl acrylamide, ethyl vinyl ether, propyl vinyl ether, butyl vinyl ether, 2-ethylbutyl vinyl ether, vinyl acetate, vinyl propionate, ethylene, propylene, 1-butene, 1-octene, dioctyl itaconate, dihexyl maleate, styrene, methylstyrene, dimethylstyrene, benzylstyrene, chloromethylstyrene, chlorostyrene, methyl vinylbenzoate, vinyl chlorobenzoate, acrylonitrile, methacrylonitrile and vinyl chloride; and monomers which form water-soluble homopolymers, such as acrylamide, N-methyl acrylamide, N-ethyl acrylamide, N-n-propyl acrylamide, N-isopropyl acrylamide, N,N-dimethyl acrylamide, N-acryloyl morpholine, N-acryloyl piperidine, methacrylamide, N-methyl methacrylamide, N-methacryloyl morpholine, N-vinyl pyrrolidone, N-vinyl acetamide, COOH-containing monomers (e.g., acrylic acid, methacrylic acid, itaconic acid, maleic anhydride) and monomers having an anionic dissociable group (e.g., 2-acrylamido-2-methylpropanesulfonic acid or a salt thereof, sodium p-styrenesulfonate, phosphonoxyethyl methacrylate).

The monomers represented by the formula (1), the monomers represented by the formula (2) or other ethylenically unsaturated monomers may be used in a combination of two or more of them.

It is desirable that the polymers comprising at least one repeating unit derived from at least one member of the monomers represented by the formula (1) are soluble in mediums used in the formation of the tabular grains. Accordingly, it is preferred that the polymers are soluble in aqueous mediums.

Namely, it is desirable that the polymers are soluble in either water or a mixed solvent of water and a water-miscible organic solvent.

The criterion of the solubility of the polymers for use in the present invention in water is such that at least 1% by weight of the polymer is dissolved in either distilled water or a mixed solvent of distilled water and methanol (9:1 by weight) at room temperature (25° C.).

The polymers used in the present invention comprise 1 to 90% by weight, preferably 3 to 85% by weight, particularly preferably 5 to 70% by weight of the monomer unit represented by the formula (1).

The copolymers comprising the monomer unit represented by the formula (2) have a preferred effect on the control of the formation of twin in the formation of the tabular grains and the monodispersibility of the grains, as compared with the copolymers comprising the monomer unit represented by the formula (1).

When the monomers represented by the formula (2) are used as the comonomers, the proportion of the monomer unit represented by the formula (2) present in the resulting copolymers varies depending on the proportion of the monomer unit represented by the formula (1) present in the copolymers, but is generally 1 to 90% by weight, preferably 2 to 70% by weight, particularly preferably 3 to 50% by weight based on the amount of the copolymer.

The amounts of other copolymerizable ethylenically unsaturated monomers can be arbitrarily varied depending on the amounts of the monomers represented by the formulas (1) and (2) copolymerized, but are generally 0 to 99% by weight, particularly preferably 0 to 90% by weight.

Further, other ethylenically unsaturated monomers may be used. When the solubility of the resulting polymers in the aqueous medium is taken into consideration, monomers which form water-soluble homopolymers are preferred. However, monomers which form water-insoluble homopolymers may be used so long as the amounts of the monomers do not have an adverse effect on the solubility of the resulting copolymers.

The molecular weights of the polymers widely vary depending on the polarity of the polymers, the types of the monomers used, etc., but are in the range of preferably $2\times10^3$ to $1\times10^6$ particularly preferably $3\times10^3$ to $5\times10^5$ in terms of weight-average molecular weight.

Specific examples of the water-soluble polymers which can be preferably used in the present invention include, but are not limited to, the following polymers. Parenthesized numerals represent the percentage by weight of the monomers in the polymer.

P-1 MP-3/ME-4/Acrylamide Copolymer (5/5/90)
P-2 MP-3/ME-4/Acrylamide Copolymer (10/10/80)
P-3 MP-3/ME-4/Acrylamide Copolymer (25/25/50)
P-4 MP-3/ME-4/Acrylamide Copolymer (35/35/30)
P-5 MP-3/ME-4 Copolymer (50/50)
P-6 MP-2/ME-3/Acrylamide Copolymer (25/15/60)
P-7 MP-5/ME-7/Acrylamide/Acrylic Acid Copolymer (20/20/50/10)
P-8 MP-1/MP-4/ME-4/Acrylamide Copolymer (15/10/25/50)
P-9 MP-5/ME-5/Methacrylamide/Acrylic Acid Copolymer (25/25/30/20)
P-10 MP-4/ME-9/Acryloyl Morpholine/Methacrylamide Acid Copolymer (20/10/50/20)
P-11 MP-16/ME-4/Acrylamide/Sodium 2-Acrylamido-2-methylpropanesulfonate Copolymer (25/15/45/15)
P-12 MP-9/ME-15/2-Hydroxyethyl Methacrylate/-Sodium Styrenesulfonate Copolymer (10/10/40/40)
P-13 MP-3/ME-2/ME-4/Acrylamide Copolymer (25/15/15/45)
P-14 MP-3/ME-13/Acrylamide Copolymer (25/25/50)
P-15 MP-8/ME-9/Methyl Methacrylate/Acrylamide Copolymer (20/20/10/50)
P-16 MP-3/Acrylamide Copolymer (10/90)
P-17 MP-3/Acrylamide Copolymer (20/80)
P-18 MP-3/Acrylamide Copolymer (50/50)
P-19 MP-3/Acrylic Acid/Acrylamide Copolymer (50/30/20)
P-20 MP-3/Acrylic Acid Copolymer (70/30)
P-21 MP-2/Methacrylamide Copolymer (30/70)
P-22 MP-4/Acrylamide Copolymer (20/80)
P-23 MP-7/Acrylamide Copolymer (40/60)
P-24 MP-5/Acrylamide/Methacrylic Acid Copolymer (25/50/25)
P-25 MP-12/N,N-Dimethyl Acrylamide/Acrylic Acid Copolymer (30/35/35)
P-26 MP-7/Diacetone Acrylamide Copolymer (30/70)
P-27 MP-13/Acrylamide/Sodium 2-Acrylamido-2-methylpropanesulfonate Copolymer (30/60/10)
P-28 MP-3/MP-18/Acrylamide/Acrylic Acid Copolymer (20/20/40/20)

The polymers used in the present invention can be prepared by various polymerization methods such as solution polymerization, precipitation polymerization, suspension polymerization, bulk polymerization and emulsion polymerization. Polymerization initiating methods include a method using a radical initiator, a method wherein light or a radiation is irradiated, and a thermal polymerization method. These polymerization methods and the polymerization initiating methods are described in *Kobunshi Gosei Hanno,* revised edition written by Teiji Tsuruta (written in Japanese published by Nikkan Kogyo Shinbun Sha 1971) and *Kobunshi Gosei No Jikkenho* written by Takayuki Otsu and M. Kinoshita (written in Japanese published by Kagaku Dojin 1972) pp. 124–154.

Of these polymerization methods, solution polymerization method using radical initiators is particularly preferred. Examples of solvents which can be used in the solution polymerization method include water and organic solvents such as ethyl acetate, methanol, ethanol, 1-propanol, 2-propanol, acetone, dioxane, N,N-dimethylformamide, N,N-dimethylacetamide, toluene, n-hexane and acetonitrile. These organic solvents may be used either alone or as a mixture of two or more of them. A mixed solvent of water and an organic solvent may be used. Water or a mixture of water and a water-miscible organic solvent is particularly preferred in the preparation of the polymers used in the present invention.

It is necessary that the polymerization temperature is set by taking the molecular weights of the resulting polymers and the types of the initiators used into consideration. It is possible that polymerization can be carried out at a temperature of from not higher than 0° to not lower than 100° C. However, polymerization is usually carried out at a temperature of 30° to 100° C.

Examples of the radical initiators which can be preferably used in the polymerization reaction include azo initiators such as 2,2'-azobis-isobutyronitrile, 2,2'-azobis(2,4-dimethylvaleronitrile), 2,2'-azobis(2-amidinopropane) dihydrochloride and 4,4'-azobis(4-cyanopentanoic acid) and peroxide initiators such as benzoyl peroxide, t-butylhydroperoxide and potassium persulfate (which may be used in combination with sodium hydrogensulfite as redox initiators).

The amounts of the polymerization initiators used vary depending on the polymerizability of the monomers used and the molecular weights of the desired polymers, but are preferably 0.01 to 10 mol %, particularly preferably 0.01 to 2.0 mol % based on the amount of the monomer component.

When it is intended that the polymers used in the present invention are obtained as the copolymers, all of the monomers to be used may be introduced into a reactor before the initiation of the polymerization, the initiator may be then added thereto, and the polymerization reaction may be carried out. However, it is preferred that the copolymers are synthesized through a stage wherein the monomer are added dropwise to the polymerization medium.

Two or more of the ethylenically unsaturated monomers to be dropwise added may be mixed and then added dropwise. Alternatively, two or more of the ethylenically unsaturated monomers may be separately added dropwise. The ethylenically unsaturated monomers may be dissolved in an appropriate auxiliary solvent and added. Examples of the auxiliary solvent include water, organic solvents (e.g., those described above) and the mixed solvents of water and the organic solvents.

The dropwise addition time varies depending on the polymerization reactivity of the ethylenically unsaturated monomers, the polymerization temperature, etc., but is preferably from 5 minutes to 8 hours, particularly preferably from 30 minutes to 4 hours. The dropwise addition rate may be constant during the course of the dropwise addition, or may be appropriately changed during the addition. When two or more of the ethylenically unsaturated monomers are separately added dropwise, the total addition time of each monomer and the dropwise addition rate of each monomer may be arbitrarily changed, if desired. Particularly, when the ethylenically unsaturated monomers are greatly different in the polymerization reactivity from each other, it is preferred that the monomer having higher reactivity is slowly added dropwise.

The polymerization initiator may be previously added to the polymerization medium, or may be added to the polymerization medium simultaneously with the addition of the ethylenically unsaturated monomers. The polymerization initiator may be dissolved in a solvent, and the resulting solution and the ethylenically unsaturated monomers may be separately added dropwise. These addition methods may be used in a combination of two or more of them.

A synthesis example of the polymer used in the present invention will be illustrated below.

SYNTHESIS EXAMPLE

Synthesis of Compound P-2

To a one liter three-necked flask equipped with a stirrer and a reflux condenser, there were added 1.0 g of MP-3, 1.0 g of ME-4, 8.0 g of acrylamide, 0.39 g of sodium hydrogensulfite, 280 ml of ethanol and 140 g of distilled water. The mixture was heated to 70° C. with stirring in a nitrogen gas stream.

Subsequently, 20 ml of an aqueous solution of 0.20 g of potassium persulfate was added thereto. After the mixture was stirred with heating for one hour, a mixed solution consisting of 0.60 g of potassium persulfate, 50 ml of ethanol and 50 ml of distilled water and a mixed solution consisting of 9.0 g of MP-3, 9.0 g of ME-4, 72 g of acrylamide, 100 ml of ethanol and 100 g of distilled water were simultaneously added dropwise thereto at an equal flow rate over a period of 1.5 hours.

After completion of the dropwise addition, 20 ml of an aqueous solution of 0.20 g of potassium persulfate was added thereto, and the mixture was stirred with heating at 70° C. for 3 hours. Ethanol was distilled off from the resulting polymer solution under reduced pressure. The product was re-precipitated from 7 liters of a mixed solvent of acetone and ethyl acetate (1:1 by volume). The resulting powder was recovered by filtration and dried under reduced pressure to obtain 85.5 g of the title polymer having a weight average molecular weight of 53,500 as measured by gel permeation chromatography.

The preparation of the silver halide emulsions of the present invention will be illustrated below.

The silver halide emulsions of the present invention can be prepared through the following stages.

Nucleation→Ripening→Growth

The above-described water-soluble polymers may be present at any stage during the course of the formation of the grains. However, it is desirable that the polymers are present at least before the growth. More specifically, it is desirable that the polymers are present preferably before the ripening, more preferably before the nucleation.

Each stage of nucleation, ripening and growth in the preparation of the silver halide emulsions according to the present invention will be illustrated below.

1. Nucleation

The nucleation of the tabular grains is generally conducted by using the double jet process wherein an aqueous solution of a silver salt and an aqueous solution of an alkali metal halide are added to a reaction vessel containing an aqueous solution of protective colloid, or the single jet process wherein an aqueous solution of a silver salt is added to a protective colloid solution containing an alkali metal halide. If desired, a method wherein an aqueous solution of an alkali metal halide is added to a protective colloid solution containing a silver salt can be used. Further, the nucleation of the tabular grains can be conducted by adding a protective colloid solution, an aqueous solution of a silver salt and an aqueous solution of an alkali metal halide to a mixer described in JP-A-2-44335 and then immediately transferring the mixture to a reaction vessel. Furthermore, the nucleation can be conducted by adding an aqueous solution of a silver salt to an aqueous solution containing an alkali metal halide and a protective colloid solution through a pipe as disclosed in U.S. Pat. No. 5,104,786.

It is preferred that protective colloid is used as the dispersion medium, and the dispersion medium is formed at a pBr of 1 to 4 in the nucleation. Examples of protective colloid include gelatin and protective colloid polymers. Alkali-processed gelatin is usually used as gelatin. However, low-molecular weight gelatin (having a molecular weight of 3,000 to 40,000) may be used. Oxidized gelatin is preferred. Other examples of suitable protective colloid include the following materials.

(1) Polyvinyl Pyrrolidone

Homopolymer of vinyl-pyrrolidone and copolymers of acrolein and pyrrolidone described in French Patent 2,031,396.

(2) Polyvinyl Alcohol

Homopolymer of vinyl alcohol, organic acid monoesters of polyvinyl alcohol described in U.S. Pat. No. 3,000,741, maleic esters of polyvinyl alcohol described in U.S. Pat. No. 3,236,653, and copolymers of polyvinyl alcohol and polyvinyl pyrrolidone described in U.S. Pat. No. 3,479,189.

(3) Polymers having thioether group

Polymers having thioether group described in U.S. Pat. Nos. 3,615,624, 3,860,428 and 3,706,564.

(4) Polyvinyl Imidazole

Homopolymer of polyvinyl imidazole, copolymers of polyvinyl imidazole and polyvinyl amide, and terpolymers of acrylamide, acrylic acid and vinylimidazole described in JP-B-43-7561 (the term "JP-B" as used herein means an "examined Japanese patent publication") and German Patents 2,012,095 and 2,012,970.

(5) Polyethyleneimine (6) Acetal Polymer

Water-soluble polyvinyl acetals described in U.S. Pat. No. 2,358,836, polyvinyl acetals having a carboxyl group described in U.S. Pat. No. 3,003,879, and polymers described in British Patent 771,155.

(7) Amino Polymer

Amino polymers described in U.S. Pat. Nos. 3,345,346, 3,706,504 and 4,350,759 and West German Patent 2,138,872, polymers having a quaternary amine described in British Patent 1,413,125 and U.S. Pat. No. 3,425,836, polymers having amino group and carboxyl group described in U.S. Pat. No. 3,511,818, and polymers described in U.S. Pat. No. 3,832,185.

(8) Polyacrylamide Polymer

Homopolymer of acrylamide, copolymers of polyacrylamide and imidated polyacrylamide described in U.S. Pat. No. 2,541,474, copolymers of acrylamide and methacrylamide described in West German Patent 1,202,132, partial aminated acrylamide polymers described in U.S. Pat. No. 3,284,207, and acrylamide polymers described in JP-B-45-14031, U.S. Pat. Nos. 3,713,834 and 3,746,548 and British Patent 788,343.

(9) Polymer having hydroxyquinoline

Polymers having hydroxyquinoline described in U.S. Pat. Nos. 4,030,929 and 4,152,161.

(10) Other Compounds

Vinyl polymers having azaindene group described in JP-A-59-8604, polyalkylene oxide derivatives described in U.S. Pat. No. 2,976,150, polyvinylamine-imide polymers described in U.S. Pat. No. 4,022,623, polymers described in U.S. Pat. Nos. 4,294,920 and 4,089,688, polyvinyl pyridine described in U.S. Pat. No. 2,484,456, vinyl polymers having imidazole group described in U.S. Pat. No. 3,520,857, vinyl polymers having triazole group described in JP-B-60-658, and water-soluble polyalkylene aminotriazoles described in Zweitshrift Wissenshaftlich Photography, Vol. 45, page 43 (1950).

The dispersion mediums are used at a concentration of preferably not higher than 10% by weight, more preferably not higher than 1% by weight.

The temperature during nucleation is preferably 5° to 60° C. When fine tabular grains having a mean grain size of not larger than 0.5 μm are to be prepared, a temperature of 5° to 48° C. is more preferred.

The pH of the dispersion medium is not higher than 8, preferably not higher than 6.

The composition of the alkali metal halide solution is such that the content of $I^-$ based on the amount of $Br^-$ is not more than upper limit of the amount of iodine which forms the solid solution of AgBrI, and preferably not more than 10 mol %.

The polymer(s) comprising the repeating unit(s) derived from the monomer(s) represented by the formula (1) can be used in an amount of 0.1 to 50 times, preferably 0.1 to 30 -times by weight the amount of silver nitrate during nucleation.

2. Ripening

Fine grains (particularly octahedral grains and singlet twin grains) in addition to tabular grains are formed in the nucleation stage 1 described above. It is necessary that before the subsequent growth stage is conducted, other grains than tabular grains are treated to extinction, and there are formed nuclei which are in a form capable of becoming tabular grains and have good monodispersibility. It is well known that Ostwald ripening subsequent to nucleation is carried out for the above purpose.

After nucleation, the pBr is immediately adjusted, the temperature is raised, and ripening is carried out until the proportion of the hexagonal tabular grains reaches the maximum. In this case, the concentration of protective colloid is adjusted. The concentration of protective colloid is in the range of preferably 1 to 10% by weight. Gelatin and protective colloid polymers are suitable as protective colloid used in this stage. Alkali-processed gelatin is usually used as gelatin. However, oxidized gelatin may be used. Examples of suitable protective colloid polymers include those already described in 1 above.

The ripening temperature is 40° to 80° C., preferably 50° to 80° C., and the pBr is 1.2 to 3.0.

Solvents for silver halide may be added to expedite the extinction of grains other than tabular grains. The concentration of the silver halide solvent added is preferably not more than 0.3 mol/liter, more preferably 0.2 mol/liter. When the resulting emulsion is used as direct reversal emulsion, silver halide solvents such as thioether compounds which are used at a neutral to acidic pH are preferred rather than $NH_3$ which is used at an alkaline pH.

The grains are ripened in the manner as described above to obtain grains comprising nearly 100% tabular grains.

After ripening is completed, the silver halide solvents are removed in the following manner when the silver halide solvents are not needed in the subsequent growth stage.

(1) An acid having the large solubility product thereof by $Ag^+$, such as $HNO_3$ is added to make the solvents ineffective when the silver halide solvents are alkaline compounds such as $NH_3$.

(2) An oxidizing agent such as $H_2O_2$ is added to make the solvents ineffective as described in JP-A-60-136736 when the thioether solvents for silver halide are used.

3. Growth

It is preferred that the pBr is kept at 1.4 to 3.5 during the crystal growth stage subsequent to the ripening stage. Further, it is preferred that the addition rates of $Ag^+$ and a halide ion during the crystal growth period are controlled so that the crystal growth rate becomes 20 to 100%, more preferably 30 to 100% of the crystal critical growth rate. In this case, the addition rates of the silver ion and the halide ion are increased with the growth of the crystal. For this purpose, the addition rates of an aqueous solution of a silver salt and an aqueous solution of a halide may be increased, or the concentrations of the aqueous solutions may be increased as described in JP-B-48-36890 and JP-B-52-16364.

It is preferred that the iodide content of AgX to be accumulated on the nuclei during the growth period is from 0 mol % to the upper limit of the amount of the iodide which forms the solid solution.

Silver halides which can be used in the present invention include silver bromide, silver iodobromide, silver chlorobromide having a silver chloride content of not higher than 30 mol % and silver chloroiodobromide having a silver chloride content of not more than 30 mol %.

The silver halide emulsion of the present invention optionally together with other emulsions can be coated on a support to provide one or more emulsion layers. These layers may be provided on one side of the support at well as on both sides thereof. Further, emulsions having different color sensitivities can be prepared from the emulsion and can be coated to provide two or more emulsion layers.

The silver halide emulsion of the present invention can be applied to black-and-white silver halide photographic materials (e.g., X-ray photographic materials, lith type photographic materials, negative films for black-and-white photographs) and color photographic materials (e.g., color negative films, color reversal films, color paper). Further, the silver halide emulsion of the present invention can be applied to light-sensitive materials for diffusion transfer process (e.g., color diffusion transfer elements, silver salt diffusion transfer elements) and heat developable light-sensitive materials (black-and-white, color).

Various techniques and inorganic and organic materials described in *Research Disclosure* No. 308119 (December 1989) can be applied to the silver halide photographic emulsions of the present invention and the silver halide photographic materials containing the same.

In addition thereto, techniques and inorganic and organic materials which can be used for the color photographic materials to which the silver halide photographic emulsions of the present invention are applicable are more specifically described in EP-A-436938 and patent specifications cited therein. Places where the techniques and the materials are described are listed below.

| | Item | Corresponding Places |
|---|---|---|
| (1) | Layers Structure | the 34th line of page 146 to the 25th line of page 147 |
| (2) | Silver Halide Emulsion | the 26th line of page 147 to the 12th line of page 148 |
| (3) | Yellow Coupler | the 35th line of page 137 to the 33rd line of page 146; and the 21st line to the 23rd line of page 149 |
| (4) | Magenta Coupler | the 24th line to the 28th line of page 149; and the 5th line of page 3 to the 55th line of page 25 of EP-A-421453 |
| (5) | Cyan Coupler | the 29th line to the 33rd line of page 149; and the 28th line of page 3 to the 2nd line of page 40 of EP-A-432804 |
| (6) | Polymer Coupler | the 34th line to the 38th line of page 149; and the 39th line of page 113 to the 37th line of page 123 of EP-A-435334 |
| (7) | Colored Coupler | the 42nd line of page 53 to the 34th line of page 137; and the 39th line to the 45th line of page 149 |
| (8) | Other Functional Coupler | the 1st line of page 7 to the 41st line of page 53; the 46th line of page 149 to the 3rd line of page 150; and the 1st line of page 3 to the 50th line of page 29 of EP-A-435334 |
| (9) | Antiseptic-Antifungal Agent | the 25th line to the 28th line of page 150 |
| (10) | Formalin Scavenger | the 15th line to the 17th line of page 149 |
| (11) | Other Additives | the 38th line to the 47th line of page 153; the 21st line of page 75 to the 56th line of page 84 of EP-A-421453; and the 40th line of page 27 to the 40th line of page 37 of EP-A-421453 |
| (12) | Dispersion Method | the 4th line to the 24th line of page 150 |
| (13) | Support | the 32nd line to the 34th line of page 150 |
| (14) | Layer Thickness and Physical Properties | the 35th line to the 49th line of page 150 |
| (15) | Color Development Stage | the 50th line of page 150 to the 47th line of page 151 |
| (16) | Desilverization Stage | the 48th line of page 151 to the 53rd line of page 152 |
| (17) | Automatic Processor | the 54th line of page 152 to the 2nd line of page 153 |
| (18) | Washing and Stabilization Stage | the 3rd line to the 37th line of page 153 |

The thus-obtained tabular silver halide emulsions of the present invention have such characteristics that:

1) The grain form is uniform;
2) The particle size distribution in terms of the diameter of the projected area is monodisperse; and
3) The grain thickness is uniform.

Individual grains can be chemical-sensitized best. When the larger size grain, the intermediate size grain and the smaller size grain are multi-coated as the high-sensitivity layer, the intermediate-sensitivity layer and the low-sensitivity layer, respectively, an interlayer effect can be sufficiently exhibited, and light-sensitive silver halide emulsions having excellent characteristics with regard to sensitivity, graininess and sharpness can be provided.

The present invention is now illustrated in greater detail by reference to the following examples which, however, are not to be construed as limiting the invention in any way.

EXAMPLE 1

One liter of an aqueous solution containing 0.15 g of KBr, 0.4 g of oxidized gelatin, 16.8 cc of 1N $HNO_3$ and 3 g of Compound (P-3) was kept at 45° C. While the solution was stirred, 14 cc of a silver nitrate solution (0.165 mol/liter) and 14 cc of a potassium bromide solution (0.155 mol/liter) were added thereto over a period of one minute. One minute after the addition, 2.98 g of KBr was added thereto, and the temperature of the mixture was raised to 60° C. over a period of 9 minutes. Immediately after the temperature was raised, 17 cc of 20% ammonium sulfate and 27 cc of 2.5N NaOH were added thereto. After the mixture was stirred for 9 minutes, 16.7 g of oxidized gelatin and 43 cc of 1N $HNO_3$ were added thereto. After the mixture was stirred for 2 minutes, 75 cc of a silver nitrate solution (0.165 mol/liter) and 83 cc of a potassium bromide solution (0.155 mol/liter) were added thereto over a period of 5 minutes. The resulting mixture was stirred for 2 minutes, and a silver nitrate solution (1.21 mol/liter) was added thereto at such an accelerating flow rate that the addition was initiated at an initial flow rate of 1 cc/min, and 627 cc was added over a period of 88 minutes. A potassium bromide solution (1.21 mol/liter) was also added while the flow rate was controlled so that a difference in potential between silver and saturated calomel electrode became −40 mV. The resulting emulsion was washed with water and dispersed. The replica image of the resulting emulsion was observed through a transmission electron microscope (TEM) (see, FIG. 1A). It can be seen that the tabular grains formed according to the present invention are monodisperse and do not have any distorted form, unlike the tabular grains obtained by the following Comparative Example 1.

COMPARATIVE EXAMPLE 1

Emulsion grains were prepared in the same manner as in Example 1 except that 0.11 g of compound PLURONIC TM31R1 used in Example 1 of EP-A-514742 was used in place of compound (P-3) used in Example 1. The replica image of the resulting emulsion grains was observed through TEM (see, FIG. 1B).

EXAMPLE 2

Figure 1B:
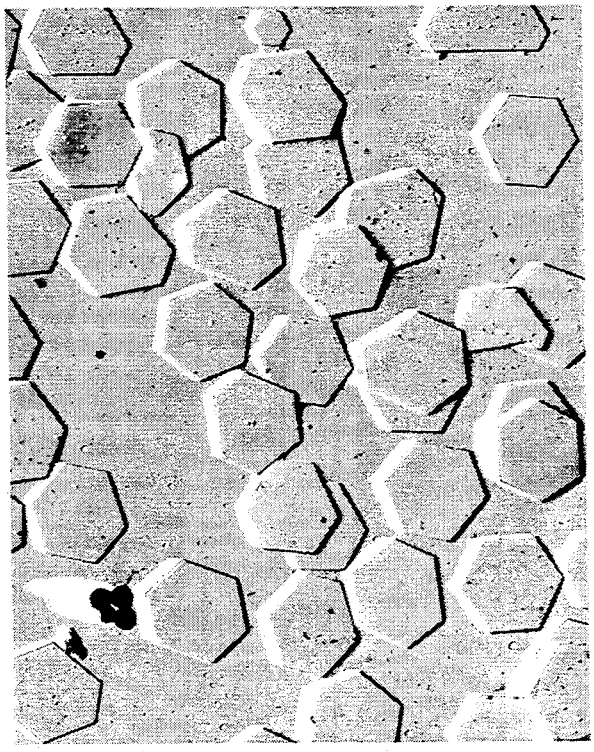

One liter of an aqueous solution containing 0.15 g of KBr, 0.4 g of oxidized gelatin, 16.8 cc of 1N $HNO_3$ and 3 g of Compound (P-3) was kept at 45° C. While the solution was stirred, 14 cc of a silver nitrate solution (0.165 mol/liter) and 14 cc of a potassium bromide solution (0.155 mol/liter) were added thereto over a period of one minute. One minute after the addition, 2.98 g of KBr was added thereto, and the temperature of the mixture was raised to 60° C. over a period of 9 minutes. Immediately after the temperature was raised, 17 cc of 20% ammonium sulfate and 27 cc of 2.5N NaOH were added thereto. After the mixture was stirred for 9 minutes, 16.7 g of oxidized gelatin and 43 cc of 1N $HNO_3$ were added thereto. After the mixture was stirred for 2 minutes, 75 cc of a silver nitrate solution (0.165 mol/liter) and 83 cc of a potassium bromide solution (0.155 mol/liter) were added thereto over a period of 5 minutes. The resulting mixture was stirred for 2 minutes, and a silver nitrate solution (1.21 mol/liter) was added thereto at such an accelerating flow rate that the addition was initiated at an initial flow rate of 1 cc/min, and 900 cc was added over a period of 107 minutes. A potassium bromide solution (1.21 mol/liter) was also added while the flow rate was controlled so that a difference in potential between silver and saturated calomel electrode became −40 mV. The resulting emulsion was washed with water and dispersed. The replica image of the resulting emulsion was observed through TEM. The characteristics of the emulsion obtained by the present invention and those of the emulsion obtained in Comparative Example 2 are shown in Table 1 below. The tabular grains formed according to the present invention are monodisperse as in Comparative Example 2, and the tabular grains have a uniform crystal form as shown in FIG. 1A, while the grains formed in Comparative Example 2 contain a considerable amount of grains having a distorted form wherein the lengths of the sides are different from each other.

COMPARATIVE EXAMPLE 2

Emulsion grains were prepared in the same manner as in Example 2 except that 0.11 g of compound PLURONIC TM31R1 used in Example 1 of EP-A-514742 was used in place of compound (P-3) used in Example 2.

TABLE 1

| | Ex. 2 | Comp. Ex. 2 |
|---|---|---|
| Proportion (%) of Projected Areas of Tabular Grains | 99.9 | 99.8 |
| Average Diameter (μm) of Projected Areas | 2.40 | 2.39 |
| Average Thickness (μm) | 0.101 | 0.104 |
| Average Aspect Ratio | 23.7 | 23.0 |
| Coefficient of Variation (%) | 4.3 | 4.6 |

EXAMPLE 3

To the emulsion prepared in Examples 1 was added sensitizing dye, 3,3-dimethylthiazolinodicarbocyanine bromide in an amount corresponding to 90% of saturated adsorption amount, and the pH of the emulsion was adjusted to 8.0. After a lapse of 20 minutes, the pAg of the emulsion was adjusted to 8.5, and a 0.005 wt % methanol solution of triethylthiourea was added to the emulsion in an amount of $0.8\times10^{-5}$ mol of triethylthiourea per mol of AgBr at an equal rate over a period of 10 minutes. The emulsion was ripened for 10 minutes. Subsequently, $0.3\times10^{-5}$ mol of gold sensitizing agent (thiocyanato gold complex) per mol of AgBr was added thereto, and the emulsion was ripened for 50 minutes. The temperature was lowered, and the emulsion was washed with water having a pBr of 1.6 twice, and unreacted sulfur sensitizing agent was removed by water washing. Subsequently, the emulsion was washed with water having a pAg of 5.0 twice, and the dye was removed by water washing. Further, the emulsion was washed with water once and re-dispersed. The temperature of the emulsion was raised to 40° C., and the following Dye 1 in an amount corresponding to 40% of saturated adsorption amount was added thereto. Further, anti-fogging agent TAI (4-hydroxy-6-methyl-1,3,3a,7-tetrazaindene) and coating aid were added thereto, and the resulting emulsion was coated.

Dye 1

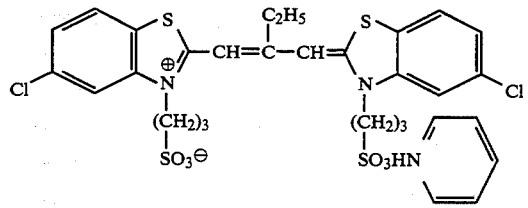

COMPARATIVE EXAMPLE 3

The emulsion prepared in Comparative Example 2 was chemical sensitized and spectral sensitized in the same manner as in Example 3, and coated.

The thus-obtained coated films were wedgewise exposed to tungsten light through a filter (color temperature: 5500° C.) for 1/100 sec, and the films were developed at 20° C. for 10 minutes by using the following surface developing solution (MAA-1).

| Surface Developing Solution (MAA-1) | |
|---|---|
| Metol | 2.5 g |
| L-Ascorbic Acid | 10.0 g |
| Potassium Bromide | 1.0 g |
| Nabox (sodium tetraborate pentahydrate, a product of Fuji Photo Film Co., Ltd.) | 35.0 g |
| Water to make | 1000 ml |

The sensitivity was determined from the resulting characteristic curve. The results obtained are shown in Table 2 below. It can be seen that the emulsion of the present invention has good sensitivity.

TABLE 2

| | Relative Sensitivity |
|---|---|
| Example 3 | 105 |
| Comp. Ex. 3 | 100 |

The reciprocal of an exposure amount (1x·sec) providing a density of (fog+0.2) is referred to as the sensitivity. The sensitivity in terms of the relative sensitivity is shown in Table 2.

EXAMPLE 4

(1) Preparation of Emulsion

Various silver iodobromide emulsions shown in Table 3 below were prepared.

TABLE 3

| Emulsion | Size (in terms of diameter of the corresponding Sphere) (μm) | Average Thickness (μm) | Form | Structure in the interior of Grain | Coefficient of Variation (%) |
|---|---|---|---|---|---|
| Q1-1 (x,y,z) | 1.0 | 0.22 | monodisperse tabular | exist | 10 |
| Q1-2 (x,y,z) | 0.5 | 0.20 | monodisperse tabular | " | 8 |
| Q1-3 (x,y,z) | 0.3 | 0.10 | monodisperse tabular | " | 8 |
| Q2-1 (x,y,z) | 1.0 | 0.22 | monodisperse tabular | " | 12 |
| Q2-2 (x,y,z) | 0.5 | 0.20 | monodisperse tabular | " | 9 |
| Q3-1 (x,y,z) | 1.0 | 0.22 | monodisperse tabular | " | 11 |
| Q3-2 (x,y,z) | 0.5 | 0.20 | monodisperse tabular | " | 9 |
| Q4-1 (x,y,z) | 1.0 | 0.22 | monodisperse tabular | " | 12 |
| Q4-2 (x,y,2) | 0.5 | 0.20 | monodisperse tabular | " | 10 |
| Q5-1 (x,y,z) | 1.0 | 0.22 | monodisperse tabular | " | 13 |
| Q5-2 (x,y,z) | 0.5 | 0.20 | monodisperse tabular | " | 11 |
| P-1 (x,y,z) | 1.0 | 0.22 | monodisperse tabular | " | 12 |
| P-2 (x,y,z) | 0.5 | 0.20 | monodisperse tabular | " | 9 |
| P-3 (x,y,z) | 0.3 | 0.11 | monodisperse tabular | " | 9 |
| R-1 (x,z) | 1.0 | — | cubic monodisperse | " | 11 |
| R-2 (x,z) | 0.5 | — | cubic monodisperse | " | 8 |
| R-3 (x,z) | 0.3 | — | cubic monodisperse | " | 7 |

In Table 3, x: AgI content (mol %)

y: average aspect ratio z: spectral sensitivity pattern (3,6,10)

This means that when a multi-layer is coated, the emulsion is prepared so that spectral sensitivity provides the following results.

3: Blue sensitivity. The wavelength which provides the maximum sensitivity is 460 nm, and the sensitivity at 480 nm in a spectral sensitivity distribution at a density of (minimum density+0.7) is 50% of maximum sensitivity.

6: Green sensitivity. The wavelength which provides the maximum sensitivity is 550 nm, and the sensitivity at 500 nm in a spectral sensitivity distribution at a density of (minimum density+0.7) is 10% of maximum sensitivity.

10: Red sensitivity. The wavelength which provides the maximum sensitivity is 650 nm.

(1) Preparation of Emulsion Q

To 1.0 liter of a 1.0 wt % aqueous solution of gelatin containing 0.04M potassium bromide, there was added 3.0 g of compound (P-3) according to the present invention. The temperature of the resulting solution was kept at 45° C., and the pH thereof was adjusted to 1.85. Subsequently, 42 cc of 0.5M silver nitrate solution and 42 cc of 0.5M potassium bromide solution were added thereto with stirring over a period of 50 seconds by the double jet method while the pAg was kept at 9.7. After the pAg was adjusted to 9.8, the temperature of the mixture was raised to 60° C. After temperature was raised to 60° C., 14 cc of 0.8N ammonium sulfate was added thereto, and the pH was adjusted to 10.0 by using NaOH. After 10 minutes, 20 g of gelatin was added thereto, and the pH was adjusted with 1N $HNO_3$ to 5.8. A silver nitrate solution containing 130 g of silver nitrate and a potassium bromide solution containing 1.7 g of potassium iodide were added thereto at an accelerating flow rate while the pAg was kept at 9.2. Further, a silver nitrate solution containing 20 g of silver nitrate and a potassium bromide solution were added thereto at an accelerating flow rate over a period of 10 minutes while the pBr was kept at 2.55. The emulsion was then desalted by conventional flocculation method. The pH of the emulsion was adjusted to 6.5, and the pAg thereof was adjusted to 8.5 at 40° C. Subsequently, the emulsion was chemical sensitized best by using sodium thiosulfate, potassium chloroaurate and potassium thiocyanate. There was obtained an emulsion comprising grains having an AgI content of 1.0 mol % and a grain size of 1 μm in terms of the diameter of the corresponding sphere.

Emulsions Q1-1 to Q1-3 were prepared in the same manner as described above except that the temperature and the amount of potassium iodide during the formation of the grains and the pBr for forming the grains were changed. Further, emulsions Q2-1 to 2, Q3-1 to 2, Q4-1 to 2 and Q5-1 to 2 were prepared in the same manner as described above except that 2 g of P-4, 4 g of P-6, 3 g of P-9 and 1 g of P-16 were used in place of P-3, respectively.

In any emulsion prepared above, tabular grains accounted for at least 98% of the entire projected areas of the entire grains having a grain size of 0.2 μm or larger in terms of the equivalent circular diameter to the projected area.

When the blue-sensitive layer was prepared, spectral sensitizing dyes S-1 and S-2 were added before chemical sensitization to determine the ratio of both dyes so as to provide the spectral sensitivity pattern as described above, and the total number of moles of the dyes to be added was determined so as to provide the highest sensitivity. When the green-sensitive emulsion was prepared, spectral sensitizing dyes S-3, S-4 and S-5 were added after completion of chemical sensitization to determine the ratio of the dyes so as to provide the spectral sensitivity pattern as described above, and the total number of moles of the dyes to be added was determined so as to provide the highest sensitivity. When the red-sensitive emulsion was prepared, spectral sensitizing dyes S-6, S-7, S-8 and S-9 were added after chemical sensitization to determine the ratio of the dyes so as to provide the spectral sensitivity pattern as described above, and the total number of moles of the dyes to be added was determined so as to provide the highest sensitivity.

(2) Preparation of Emulsion P-1 to 3

To 1.0 liter of a 1.0 wt % aqueous solution of gelatin containing 0.04M potassium bromide, there was added 0.3 g of PLURONIC TM31R1 (compound described in EP-A-514742). The temperature of the resulting solution was kept at 45° C., and the pH thereof was adjusted to 1.85. Subsequently, 42 cc of 0.5M silver nitrate solution and 42 cc of 0.5M potassium bromide solution were added thereto with stirring over a period of 50 seconds by the double jet method while the pAg was kept at 9.7. After the pAg was adjusted to 9.8, the temperature of the mixture was raised to 60° C. After the temperature was raised to 60° C., 14 cc of 0.8N ammonium sulfate was added thereto, and the pH was adjusted to 10.0 by using NaOH. After 10 minutes, 20 g of gelatin was added thereto, and the pH was adjusted with 1N $HNO_3$ to 5.8. A silver nitrate solution containing 130 g of silver nitrate and a potassium bromide solution containing 1.7 g of potassium iodide were added thereto at an accelerating flow rate while the pAg was kept at 9.2.

Further, a silver nitrate solution containing 20 g of silver nitrate and a potassium bromide solution were added thereto at an accelerating flow rate over a period of 10 minutes while the pBr was kept at 2.55. The emulsion was then desalted by conventional flocculation method. The pH of the emulsion was adjusted to 6.5, and the pAg thereof was adjusted to 8.5 at 40° C. Subsequently, the emulsion was chemical sensitized best by using sodium thiosulfate, potassium chloroaurate and potassium thiocyanate. There was obtained an emulsion comprising grains having an AgI content of 1.0 mol % and a grain size of 1 μm in terms of the diameter of the corresponding sphere. In the same manner as described above, emulsions were prepared by changing the temperature and the amount of potassium iodide during the formation of the grains and the pBr for forming the grains. The emulsions were spectral sensitized in the same manner as in the spectral sensitization of the emulsions Q1-1 to 3 to form emulsions P-1 to 3.

In any emulsion prepared above, tabular grains accounted for at least 98% of the entire projected areas of the entire grains having a grain size of 0.2 μm or larger in terms of the equivalent circular diameter to the projected area.

(3) Preparation of Emulsion R-1 to 3

$NH_4OH$ was added to 1.0 liter of a 3.0 wt % gelatin solution kept at 60° C. to adjust the pH to 10.3. Subsequently, 42 cc of 0.5M silver nitrate solution and 42 cc of 0.5M potassium bromide solution were added to the above solution over a period of 2 minutes by the double jet method. After 10 minutes, 100 cc of 1.0M silver nitrate solution was slowly added thereto, and the pH thereof was restored to the original one. Further, an aqueous solution of 130 g of silver nitrate and an aqueous solution of potassium bromide containing 1.7 g of potassium iodide were added thereto at a given flow rate over a period of 60 minutes while the pBr was kept at 2.90. Further, an aqueous solution of 20 g of silver nitrate and an aqueous solution of potassium bromide were added thereto at a given flow rate over a period of 10 minutes while the pBr was kept at 2.85. The emulsion was then desalted by conventional flocculation method. The pH of the emulsion was adjusted to 6.5, and the pAg thereof was adjusted to 8.5 at 40° C. Subsequently, the emulsion was optimally chemical sensitized by using sodium thiosulfate, potassium chloroaurate and potassium thiocyanate. There was obtained an emulsion comprising grains having an AgI content of 1.0 mol % and a grain size of 1 μm in terms of the diameter of the corresponding sphere. In the same manner as described above, emulsions were prepared by changing the temperature and the amount of potassium iodide during the formation of the grains, and the emulsions were spectral sensitized in the same manner as in the spectral sensitization of the emulsion Q1-1 to 3 to form emulsions R-1 to 3.

The sensitivity of the emulsions prepared above was higher, the larger the size of the grains.

Preparation of Samples 301 to 310

The following layers were coated on an undercoated cellulose triacetate film support of 127 μm in thickness to prepare each of samples 301 to 310 having the following basic structure (as shown in Table 4 below). Numerals represents amounts per $m^2$.

TABLE 4

| Emulsion | Sample No. | | | | | | | | | |
|---|---|---|---|---|---|---|---|---|---|---|
| No. | 301 | 302 | 303 | 304 | 305 | 306 | 307 | 308 | 309 | 310 |
| (Polymer) | Pluronic 31R1 | | | P-3 | P-3 | P-3 | P-4 | P-6 | P-9 | P-16 |
| (1) | R-3 (4,10) | R-3 (5,10) | P-3 (5,3,10) | R-3 (4,10) | R-3 (5,10) | Q1-3 (5,3,10) | R-3 (5,10) | R-3 (5,10) | R-3 (5,10) | R-3 (5,10) |
| (2) | R-2 (5,10) | R-2 (4,10) | P-2 (4,5,10) | R-2 (5,10) | R-2 (4,10) | Q1-2 (4,5,10) | R-2 (4,10) | R-2 (4,10) | R-2 (4,10) | R-2 (4,10) |
| (3) | P-1 (2,8,10) | P-1 (2,5,10) | P-1 (2,8,10) | Q1-1 (2,8,10) | Q1-1 (2,5,10) | Q1-1 (2,8,10) | Q2-1 (2,5,10) | Q3-1 (2,5,10) | Q4-1 (2,5,10) | Q5-1 (2,5,10) |
| (4) | R-3 | R-3 | P-3 | R-3 | R-3 | Q1-3 | R-3 | R-3 | R-3 | R-3 |

TABLE 4-continued

| Emulsion No. (Polymer) | Sample No. 301 | 302 | 303 | 304 | 305 | 306 | 307 | 308 | 309 | 310 |
|---|---|---|---|---|---|---|---|---|---|---|
| | Pluronic 31R1 | | | P-3 | P-3 | P-3 | P-4 | P-6 | P-9 | P-16 |
| | (4,6) | (4,6) | (4,4,6) | (4,6) | (4,6) | (4,4,6) | (4,6) | (4,6) | (4,6) | (4,6) |
| (5) | R-2 | R-2 | P-2 | R-2 | R-2 | Q1-2 | R-2 | R-2 | R-2 | R-2 |
| | (3,6) | (3,6) | (3,5,6) | (3,6) | (3,6) | (3,5,6) | (3,6) | (3,6) | (3,6) | (3,6) |
| (6) | P-1 | P-1 | P-1 | Q1-1 | Q1-1 | Q1-1 | Q2-1 | Q3-1 | Q4-1 | Q5-1 |
| | (2,8,6) | (2,8,6) | (2,8,6) | (2,8,6) | (2,8,6) | (2,8,6) | (2,8,6) | (2,8,6) | (2,8,6) | (2,8,6) |
| (7) | R-3 | R-3 | P-3 | R-3 | R-3 | Q1-3 | R-3 | R-3 | R-3 | R-3 |
| | (3,3) | (3,3) | (3,5,3) | (3,3) | (3,3) | (3,5,3) | (3,3) | (3,3) | (3,3) | (3,3) |
| (8) | P-2 | P-2 | P-2 | Q-2 | Q1-2 | Q1-2 | Q2-2 | Q3-2 | Q4-2 | Q5-2 |
| | (2,5,3) | (2,8,3) | (2,8,3) | (2,5,3) | (2,8,3) | (2,8,3) | (2,8,3) | (2,8,3) | (2,8,3) | (2,8,3) |
| (9) | P-1 | P-1 | P-1 | Q1-1 | Q1-1 | Q1-1 | Q2-1 | Q3-1 | Q4-1 | Q5-1 |
| | (2,8,3) | (2,12,3) | (2,12,3) | (2,8,3) | (2,12,3) | (2,12,3) | (2,12,3) | (2,12,3) | (2,12,3) | (2,12,3) |
| Remarks | Comp. Ex. | Comp. Ex. | Comp. Ex. | Invention | Invention | Invention | Invention | Invention | Invention | Invention |

| | |
|---|---|
| First layer: Antihalation Layer | |
| Black Colloidal Silver (in terms of silver) | 0.20 g |
| Gelatin | 1.9 g |
| Ultraviolet Light Absorber U-1 | 0.1 g |
| Ultraviolet Light Absorber U-3 | 0.04 g |
| Ultraviolet Light Absorber U-4 | 0.1 g |
| High-Boiling Organic Solvent Oil-1 | 0.1 g |
| Crystallite Solid Dispersion of Dye E-1 | 0.1 g |
| Second Layer: Interlayer | |
| Gelatin | 0.40 g |
| Compound Cpd-C | 5 mg |
| Compound Cpd-J | 5 mg |
| Compound Cpd-K | 3 mg |
| High-Boiling organic Solvent Oil-3 | 0.1 g |
| Dye D-4 | 0.8 mg |
| Third Layer: Interlayer | |
| Fine Grain Silver Iodobromide Emulsion wherein the surface layer of the grain and the interior thereof were fogged (mean grain size: 0.06 μm; a coefficient of variation: 18%; AgI content: 1 mol %) (in terms of silver) | 0.05 g |
| Yellow Colloidal Silver (in terms of silver) | 0.05 g |
| Gelatin | 0.4 g |
| Fourth Layer: Low-Sensitivity Red-Sensitive Emulsion | |
| Emulsion (1) (in terms of silver) | 0.5 g |
| Monodisperse Cubic Internal Latent Image Type Emulsion (mean grain size: 0.3 μm; a coefficient of variation: 10%; AgI content: 4 mol %) (in terms of silver) | 0.1 g |
| Fine Grain Silver Iodobromide Emulsion wherein the interior of the grain was fogged (mean grain size: 0.06 μm; a coefficient of variation: 18%; AgI content: 1 mol %) (in terms of silver) | 0.05 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 5 mg |
| Compound Cpd-J | 5 mg |
| High-Boiling Organic Solvent Oil-2 | 0.1 g |
| Additive PM-1 | 0.1 g |
| Fifth Layer: Intermediate-Sensitivity Red-Sensitive Emulsion Layer | |
| Emulsion (2) (in terms of silver) | 0.5 g |
| Fine Grain Silver Iodobromide Emulsion wherein the interior of the grain was fogged (mean grain size: 0.06 μm; a coefficient of variation: 18%; AgI content: 1 mol %) (in terms of silver) | 0.05 g |
| Gelatin | 0.8 g |
| Coupler C-1 | 0.2 g |
| Coupler C-2 | 0.05 g |
| Coupler C-3 | 0.2 g |
| High-Boiling Organic Solvent Oil-2 | 0.1 g |
| Additive PM-1 | 0.1 g |

-continued

| | |
|---|---|
| Sixth Layer: High-Sensitivity Red-Sensitive Emulsion Layer | |
| Emulsion (3) (in terms of silver) | 0.4 g |
| Gelatin | 1.1 g |
| Coupler C-1 | 0.3 g |
| Coupler C-2 | 0.1 g |
| Coupler C-3 | 0.7 g |
| Additive PM-1 | 0.1 g |
| Seventh Layer: Interlayer | |
| Gelatin | 0.6 g |
| Additive M-1 | 0.3 g |
| Color Mixing Inhibitor Cpd-I | 2.6 mg |
| Dye D-5 | 0.02 g |
| Compound Cpd-J | 5 mg |
| High-Boiling Organic Solvent Oil-1 | 0.02 g |
| Eighth Layer: Interlayer | |
| Silver Iodobromide Emulsion wherein the surface layer of the grain and the interior thereof were fogged (mean grain size: 0.06 μm; a coefficient of variation: 16%; AgI content: 0.3 mol %) (in terms of silver) | 0.02 g |
| Yellow Colloidal Silver (in terms of silver) | 0.02 g |
| Gelatin | 1.0 g |
| Additive PM-1 | 0.2 g |
| Color Mixing Inhibitor Cpd-A | 0.1 g |
| Compound Cpd-C | 0.1 g |
| Ninth Layer: Low-Sensitivity Green-Sensitive Emulsion Layer | |
| Emulsion (4) (in terms of silver) | 0.5 g |
| Monodisperse Cubic Internal Latent Image Type Emulsion (mean grain size: 0.35 μm; a coefficient of variation: 11%; AgI content: 3 mol %) (in terms of silver) | 0.1 g |
| Fine Grain Silver Iodobromide Emulsion wherein the interior of the grain was fogged (mean grain size: 0.06 μm; a coefficient of variation: 18%; AgI content: 1 mol %) (in terms of silver) | 0.04 g |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-J | 10 mg |
| Compound Cpd-L | 0.02 g |
| High-Boiling Organic Solvent Oil-1 | 0.1 g |
| High-Boiling Organic Solvent Oil-2 | 0.1 g |
| Tenth Layer: Intermediate-Sensitivity Green-Sensitive Emulsion Layer | |
| Emulsion (5) (in terms of silver) | 0.4 g |
| Fine Grain Silver Iodobromide Emulsion wherein the interior of the grain was fogged (mean grain size: 0.06 μm; a coefficient of variation: 18%; AgI | 0.04 g |

-continued

| | |
|---|---|
| content: 1 mol %) (in terms of silver) | |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High-Boiling Organic Solvent Oil-2 | 0.01 g |
| Eleventh Layer: High-Sensitivity Green-Sensitive Emulsion Layer | |
| Emulsion (6) (in terms of silver) | 0.5 g |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-E | 0.02 g |
| Compound Cpd-F | 0.04 g |
| Compound Cpd-K | 5 mg |
| Compound Cpd-L | 0.02 g |
| High-Boiling organic Solvent Oil-1 | 0.02 g |
| High-Boiling Organic Solvent Oil-2 | 0.02 g |
| Twelfth Layer: Interlayer | |
| Gelatin | 0.6 g |
| Compound Cpd-L | 0.05 g |
| High-Boiling Organic Solvent Oil-1 | 0.05 g |
| Thirteenth Layer: Yellow Filter Layer | |
| Yellow Colloidal Silver (in terms of silver) | 0.07 g |
| Gelatin | 1.1 g |
| Color Mixing Inhibitor Cpd-A | 0.01 g |
| Compound Cpd-L | 0.01 g |
| High-Boiling Organic Solvent Oil-1 | 0.01 g |
| Crystallite Solid Dispersion of Dye E-2 | 0.05 g |
| Fourteenth Layer: Interlayer | |
| Gelatin | 0.6 g |
| Fifteenth Layer: Low-Sensitivity Blue-Sensitive Emulsion Layer | |
| Emulsion (7) (in terms of silver) | 0.5 g |
| Gelatin | 0.8 g |
| Coupler C-5 | 0.2 g |
| Coupler C-6 | 0.1 g |
| Coupler C-10 | 0.4 g |
| Sixteenth Layer: Intermediate-Sensitivity Blue-Sensitive Emulsion Layer | |
| Emulsion (8) (in terms of silver) | 0.4 g |

-continued

| | |
|---|---|
| Gelatin | 0.9 g |
| Coupler C-5 | 0.1 g |
| Coupler C-6 | 0.1 g |
| Coupler C-10 | 0.6 g |
| Seventeenth Layer: High-Sensitivity Blue-Sensitive Emulsion Layer | |
| Emulsion (9) (in terms of silver) | 0.4 g |
| Gelatin | 1.2 g |
| Coupler C-5 | 0.1 g |
| Coupler C-6 | 0.1 g |
| Coupler C-10 | 0.6 g |
| High-Boiling Organic Solvent Oil-2 | 0.1 g |
| Eighteenth Layer: First Protective Layer | |
| Gelatin | 0.7 g |
| Ultraviolet Light Absorber U-1 | 0.2 g |
| Ultraviolet Light Absorber U-2 | 0.05 g |
| Ultraviolet Light Absorber U-5 | 0.3 g |
| Formalin Scavenger Cpd-H | 0.4 g |
| Dye D-1 | 0.15 g |
| Dye D-2 | 0.05 g |
| Dye D-3 | 0.1 g |
| Nineteenth Layer: Second Protective Layer | |
| Colloidal Silver (in terms of silver) | 0.1 mg |
| Fine Grain Silver Iodobromide Emulsion (mean grain size: 0.06 μm; AgI content: 1 mol %) (in terms of silver) | 0.1 g |
| Gelatin | 0.4 g |
| Twentieth Layer: Third Protective Layer | |
| Gelatin | 0.4 g |
| Polymethyl Methacrylate (average particle size: 1.5 μm) | 0.1 g |
| Copolymer of Methyl Methacrylate and Acrylic Acid (4:6) (average particle size: 1.5 μm) | 0.1 g |
| Silicone Oil | 0.03 g |
| Surfactant W-1 | 3.0 mg |
| Surfactant W-2 | 0.03 g |

Additives F-1 to F-8 in addition to the above described ingredients were added to all of the emulsion layers. Further, a hardening agent H-1 for gelatin and surfactants W-3, W-4, W-5 and W-6 for coating and emulsification in addition to the above-described ingredients were added to each layer.

Furthermore, phenol, 1,2-benzisothiazoline-3-one, 2-phenoxyethanol, phenethyl alcohol and butyl p-benzoate as antiseptic and antifungal agents were added.

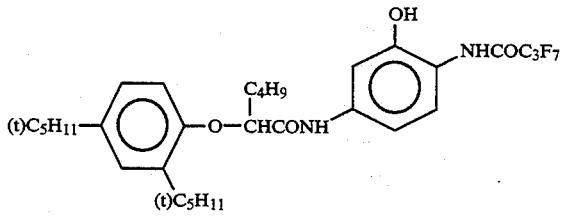

C-1

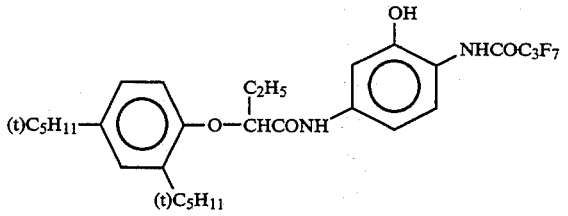

C-2

-continued
C-3
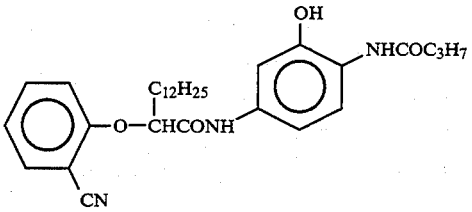
C-4
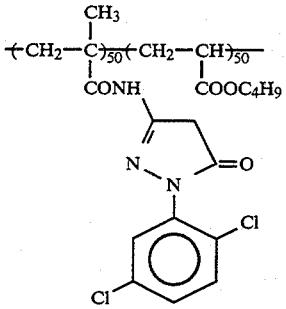
Numeral: % by weight
Average Mol. Wt.: about 25,000
C-5
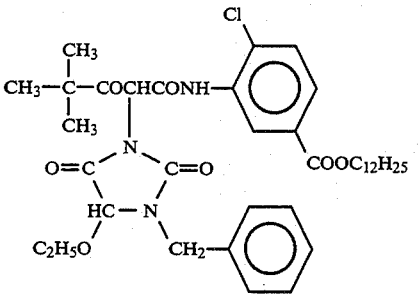
C-6
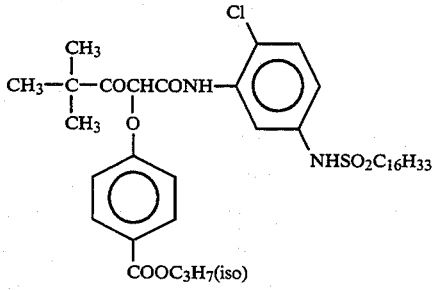
C-7
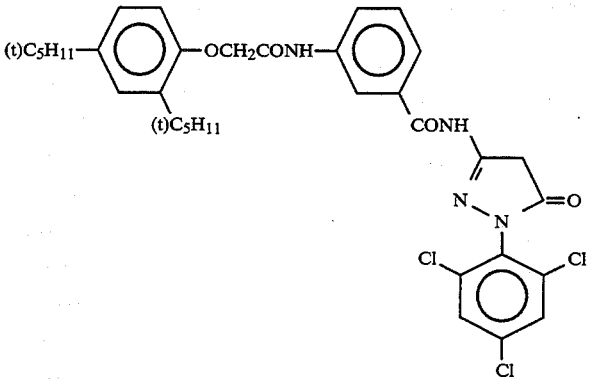

-continued
C-8
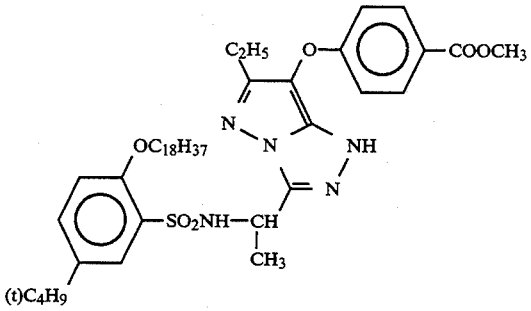
C-9
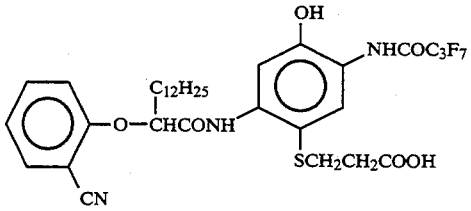
C-10
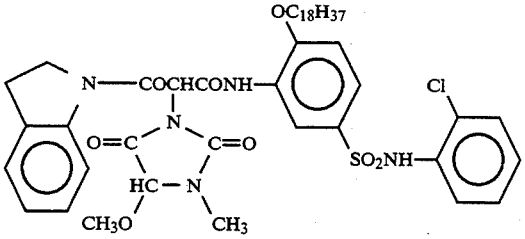
Dibutyl Phthalate Oil-1
Tricresyl Phosphate Oil-2
Oil-3
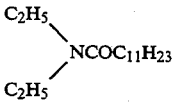
Cpd-A
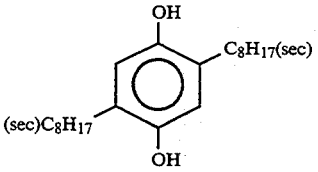
Cpd-B
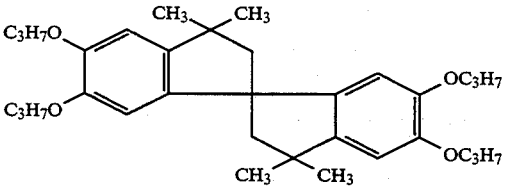
Cpd-C
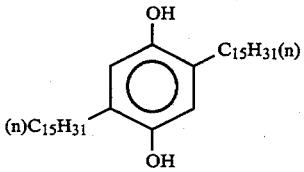
Cpd-D
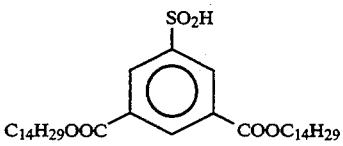

-continued
Cpd-E
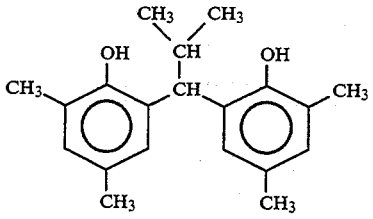
Cpd-F
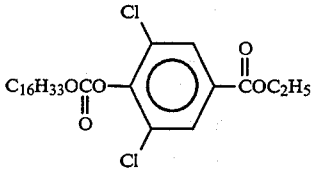
Cpd-H
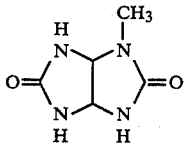
Cpd-I
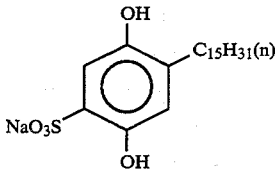
Cpd-J
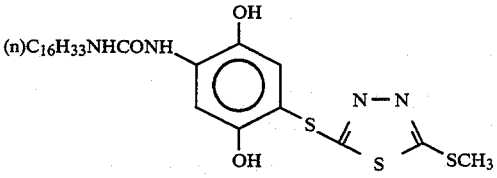
Cpd-K
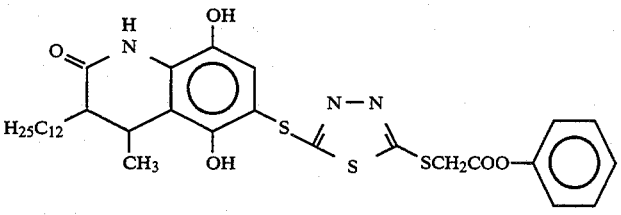
Cpd-L
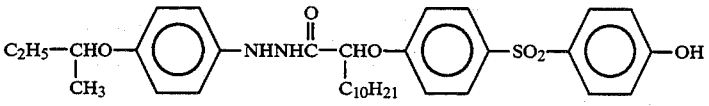
U-1
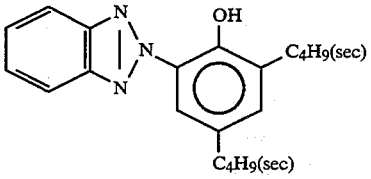
U-2
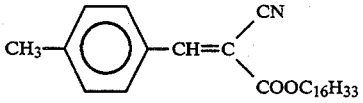

-continued
U-3
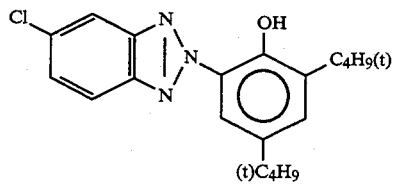
U-4
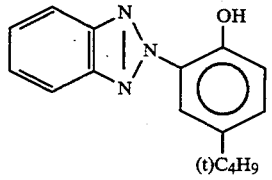
U-5
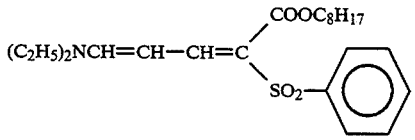
S-1
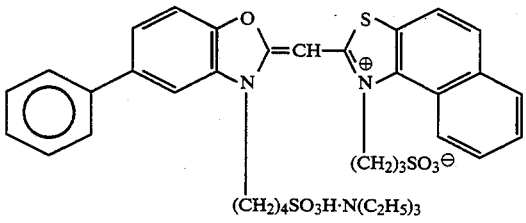
S-2
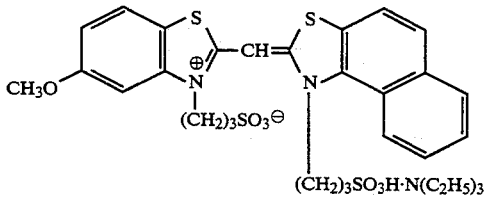
S-3
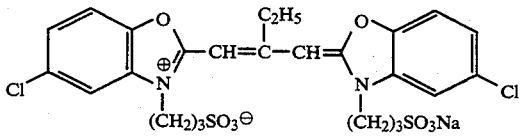
S-4
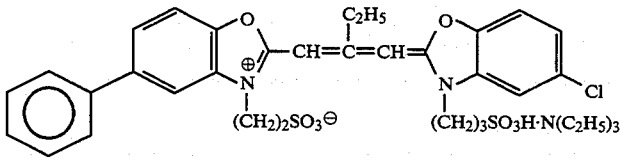
S-5
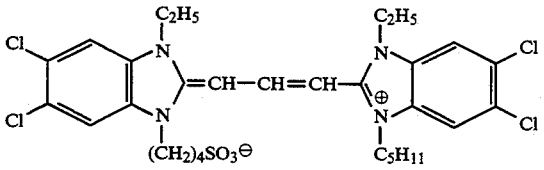
S-6
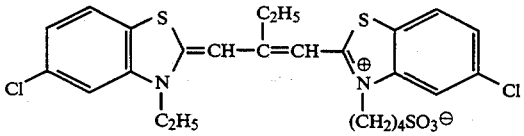

-continued
S-7
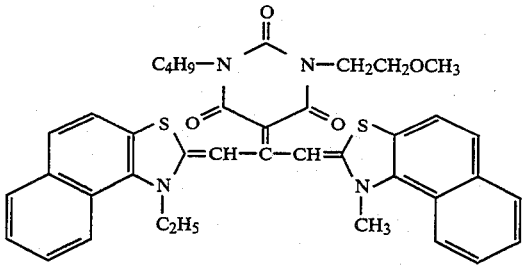
S-8
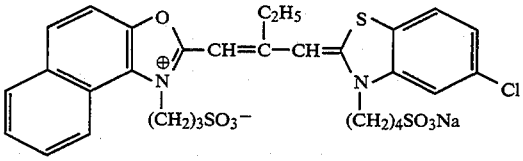
S-9
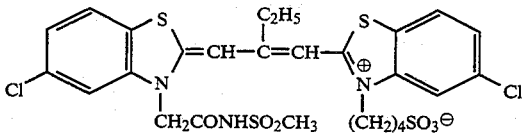
D-1
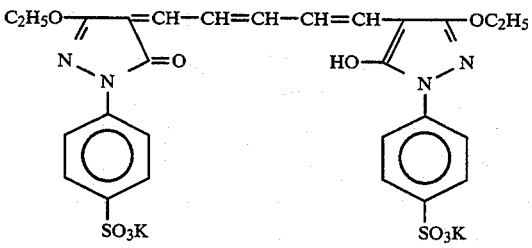
D-2
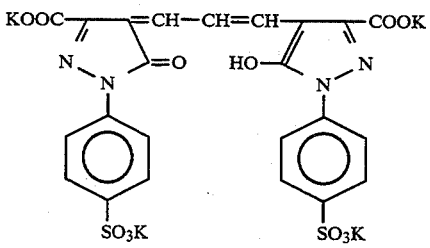
D-3
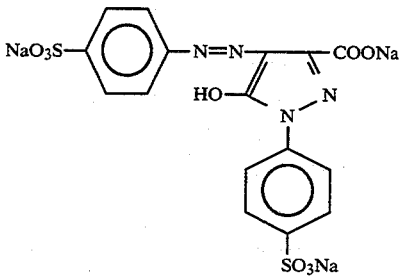

-continued
D-4
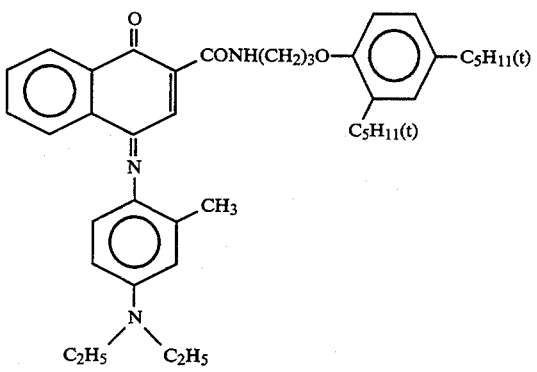
D-5
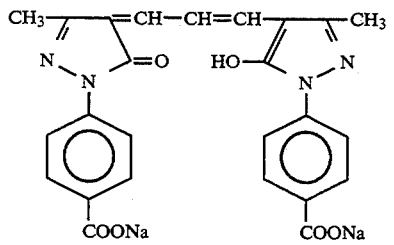
E-1
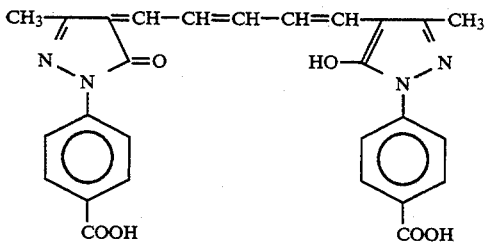
E-2
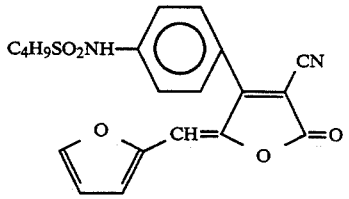
H-1
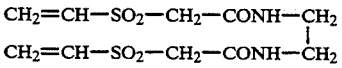
W-1
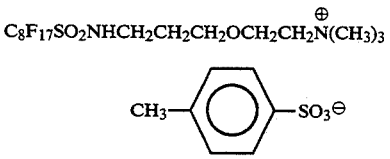
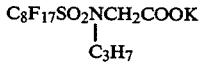
W-2
W-3
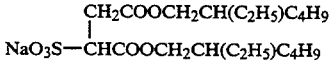
W-4
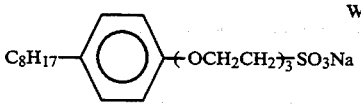

-continued
W-5
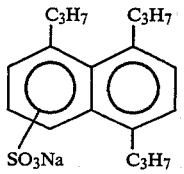
W-6
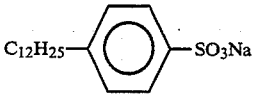
PM-1
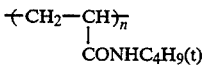
M-1
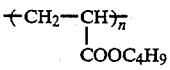
F-1
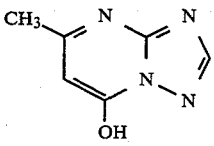
F-2
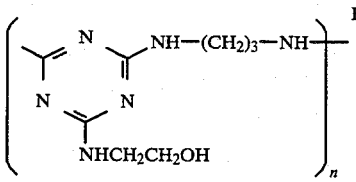
—$HNO_3$
F-3
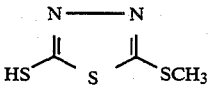
F-4
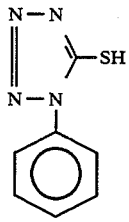
F-5
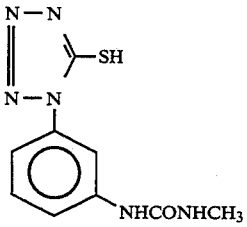
F-6
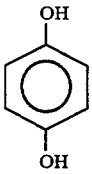

-continued

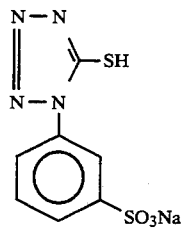

F-7

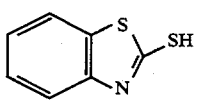

F-8

The samples 301 to 310 were exposed to light and processed in the followed manner. The results obtained are shown in Table 5 below. Sharpness is represented by MTF value (20 lines/mm), and RMS granularity is represented by the value of 1,000 times the standard deviation of fluctuation in density at a density of 1.0 obtained by conducting scanning with a microdensitometer. Further, various photographing was made to make evaluation.

TABLE 5

| | Sample No. | | | | | | | | | |
|---|---|---|---|---|---|---|---|---|---|---|
| | 301 | 302 | 303 | 304 | 305 | 306 | 307 | 308 | 309 | 310 |
| Sharpness (20 lines/mm) | | | | | | | | | | |
| Red-Sensitive | 0.94 | 0.95 | 0.99 | 0.95 | 0.95 | 0.99 | 0.95 | 0.96 | 0.95 | 0.96 |
| Green-Sensitive | 1.09 | 1.10 | 1.15 | 1.10 | 1.11 | 1.17 | 1.10 | 1.10 | 1.10 | 1.10 |
| Blue-Sensitive | 1.31 | 1.33 | 1.36 | 1.31 | 1.34 | 1.37 | 1.35 | 1.34 | 1.34 | 1.33 |
| Granularity | | | | | | | | | | |
| Red-Sensitive | 13.0 | 13.0 | 12.7 | 12.1 | 12.3 | 11.7 | 12.2 | 12.4 | 12.3 | 12.2 |
| Green-Sensitive | 13.7 | 13.7 | 13.3 | 12.8 | 12.9 | 12.3 | 12.5 | 12.7 | 12.8 | 12.7 |
| Blue-Sensitive | 18.7 | 18.6 | 18.2 | 18.0 | 17.6 | 17.4 | 17.8 | 17.6 | 17.8 | 17.8 |
| Relative Sensitivity when subjected to gray exposure (density 1.5) | 100 | 100 | 102 | 103 | 105 | 106 | 104 | 103 | 105 | 103 |

It is apparent from the results shown in Table 5 that when the comparison between the sample 301 and the sample 304, the comparison between the sample 302 and each of the samples 305 and 307 to 310 and the comparison between the sample 303 and the sample 306 are made, said samples containing the monodisperse emulsion in the same layer, the samples containing the monodisperse emulsion comprising the tabular grains prepared by using the compounds according to the present invention have characteristics with regard to any of sharpness, granularity and sensitivity which are substantially equal to or superior to those of the samples containing the monodisperse emulsion comprising the tabular grains prepared by using PLURONIC TM31R1 used for the purpose of comparison.

| Processing Stage | Time | Temperature |
|---|---|---|
| First Development | 6 min | 38° C. |
| Washing | 2 min | 38° C. |
| Reversal | 2 min | 38° C. |
| Color Development | 6 min | 38° C. |
| Prebleaching | 2 min | 38° C. |
| Bleaching | 6 min | 38° C. |
| Fixing | 4 min | 38° C. |
| Washing | 4 min | 38° C. |
| Final Rinse | 1 min | 25° C. |

Each processing solution had the following composition.

| First Developing Solution | |
|---|---|
| Pentasodium Nitrilo-N,N,N-trimethylene-phosphonate | 1.5 g |
| Pentasodium Diethylenetriaminepenta-acetate | 2.0 g |
| Sodium Sulfite | 30 g |
| Potassium Hydroquinonemonosulfonate | 20 g |
| Potassium Carbonate | 15 g |
| Sodium Bicarbonate | 12 g |
| 1-Phenyl-4-methyl-4-hydroxymethyl-3-pyrazolidone | 1.5 g |
| Potassium Bromide | 2.5 g |
| Potassium Thiocyanate | 1.2 g |
| Potassium Iodide | 2.0 mg |
| Diethylene Glycol | 13 g |
| Water to make | 1000 ml |
| pH | 9.60 |

The pH was adjusted with sulfuric acid or potassium hydroxide.

| Reversal Solution | |
|---|---|
| Pentasodium Nitrilo-N,N,N-trimethylene-phosphonate | 3.0 g |
| Stannous Chloride Dihydrate | 1.0 g |
| p-Aminophenol | 0.1 g |
| Sodium Hydroxide | 8 g |
| Glacial Acetic Acid | 15 ml |
| Water to make | 1000 ml |
| pH | 6.00 |

The pH was adjusted with acetic acid or sodium hydroxide.

| Color Developing Solution | |
|---|---|
| Pentasodium Nitrilo-N,N,N-trimethylene-phosphonate | 2.0 g |
| Sodium Sulfite | 7.0 g |

-continued

| Color Developing Solution | |
|---|---|
| Trisodium Phosphate Dodecahydrate | 36 g |
| Potassium Bromide | 1.0 g |
| Potassium Iodide | 90 mg |
| Sodium Hydroxide | 3.0 g |
| Citrazinic Acid | 1.5 g |
| N-Ethyl-N-(β-methanesulfonamidoethyl)-3-methyl-4-aminoaniline 3/2 Sulfate Monohydrate | 11 g |
| 3,6-Dithiaoctane-1,8-diol | 1.0 g |
| Water to make | 1000 ml |
| pH | 11.80 |

The pH was adjusted with sulfuric acid or potassium hydroxide.

| Prebleaching | |
|---|---|
| Disodium Ethylenediaminetetraacetate Dihydrate | 8.0 g |
| Sodium Sulfite | 6.0 g |
| 1-Thioglycerol | 0.4 g |
| Formaldehyde Sodium Bisulfite Adduct | 30 g |
| Water to make | 1000 ml |
| pH | 6.20 |

The pH was adjusted with acetic acid or sodium hydroxide.

| Bleaching Solution | |
|---|---|
| Disodium Ethylenediaminetetraacetate Dihydrate | 2.0 g |
| Ammonium Ethylenediaminetetraacetato Ferrate Dihydrate | 120 g |
| Potassium Bromide | 100 g |
| Ammonium Nitrate | 10 g |
| Water to make | 1000 ml |
| pH | 5.70 |

The pH was adjusted with nitric acid or sodium hydroxide.

| Fixing Solution | |
|---|---|
| Ammonium Thiosulfate | 80 g |
| Sodium Sulfite | 5.0 g |
| Sodium Bisulfite | 5.0 g |
| Water to make | 1000 ml |
| pH | 6.60 |

The pH was adjusted with acetic acid or ammonia water.

| Final Rinsing Solution | |
|---|---|
| 1,2-Benzisothiazoline-3-one | 0.02 g |
| Polyoxyethylene p-Monononylphenyl Ether (an average degree of polymerization: 10) | 0.3 g |
| Polymaleic Acid (average molecular weight: 2,000) | 0.1 g |
| Water to make | 1000 ml |
| pH | 7.0 |

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising tabular grains prepared in the presence of at least one member of polymers comprising at least one repeating unit derived from at least one member of monomers represented by the following formula (1)

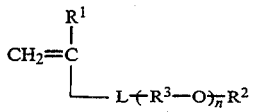

(1)

wherein $R^1$ represents a hydrogen atom or a lower alkyl group; $R^2$ represents a monovalent substituent group; $R^3$ represents an alkylene group having 3 to 10 carbon atoms; L represents a bivalent bonding group; and n represents the mean number of a repeating unit represented by $—R^3—O—$ and is a number of at least 4, but not more than 200.

2. The silver halide photographic emulsion as in claim 1, wherein said polymers are copolymers comprising at least one repeating unit derived from at least one member of the monomers represented by the formula (1) and at least one repeating unit derived from at least one member of monomers represented by the following formula (2)

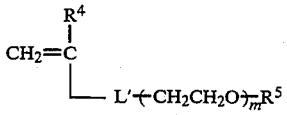

(2)

wherein $R^4$ represents a hydrogen atom or a lower alkyl group; $R^5$ represents a monovalent substituent group; L' represents a bivalent bonding group; and m represents the mean number of a repeating unit represented by $—CH_2CH_2O—$ and is a number of at least 4, but not more than 200.

3. The silver halide photographic emulsion as in claim 1, wherein the silver halide photographic emulsion comprises tabular grains having an aspect ratio of at least 2 and a coefficient of variation in grain size distribution in terms of the diameter of the corresponding circle of 15% or lower.

4. The silver halide photographic emulsion as in claim 1, wherein said polymers are soluble in aqueous media.

5. The silver halide photographic emulsion as in claim 1, wherein $R^3$ is $—CH(CH_3)CH_2—$ or $—CH_2CH(CH_3)—$.

6. The silver halide photographic emulsion as in claim 2, wherein n is 6 to 40, and m is 6 to 50.

7. The silver halide photographic emulsion as in claim 2, wherein said copolymer comprises 5 to 70% by weight of the monomer unit represented by the formula (1) and 3 to 50% by weight of the monomer unit represented by the formula (2), based on the amount of the copolymer.

8. The silver halide photographic emulsion as in claim 1, wherein said polymers are present at least before the growth of the grains in an amount of 0.1 to 30 times by weight the amount of silver nitrate during nucleation.

9. A silver halide photographic material comprising a support having thereon at least one light-sensitive silver halide emulsion layer, wherein said silver halide emulsion layer contains a silver halide emulsion comprising tabular grains prepared in the presence of at least one member of polymers comprising at least one repeating unit derived from at least one member of monomers represented by the following formula (1)

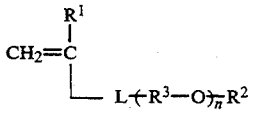
(1)
wherein $R^1$ represents a hydrogen atom or a lower alkyl group; $R^2$ represents a monovalent substituent group; $R^3$ represents an alkylene group having 3 to 10 carbon atoms; L represents a bivalent bonding group; and n represents the mean number of a repeating unit represented by $—R^3—O—$ and is a number of at least 4, but not more than 200.
* * * * *